US010222153B1

(12) United States Patent
Harding

(10) Patent No.: US 10,222,153 B1
(45) Date of Patent: Mar. 5, 2019

(54) FOLLOWER FOR BLANK CARTRIDGES, UNITARY/INTEGRATED MAGAZINE WITH FOLLOWER, AND METHODS FOR MANUFACTURING SAME

(71) Applicant: SafeTacMag, LLC, Lewisville, TX (US)

(72) Inventor: Matthew A. Harding, Lewisville, TX (US)

(73) Assignee: SafeTacMag, LLC, Lewisville, TX (US)

( * ) Notice: Subject to any disclaimer, the term of this patent is extended or adjusted under 35 U.S.C. 154(b) by 0 days.

(21) Appl. No.: 15/723,164

(22) Filed: Oct. 2, 2017

Related U.S. Application Data

(63) Continuation of application No. 15/349,579, filed on Nov. 11, 2016, now Pat. No. 9,784,512, which is a continuation of application No. 14/789,951, filed on Jul. 1, 2015, now Pat. No. 9,523,546.

(60) Provisional application No. 62/019,858, filed on Jul. 1, 2014.

(51) Int. Cl.

| | |
|---|---|
| ***F41A 9/71*** | (2006.01) |
| ***F41A 9/70*** | (2006.01) |
| ***F41A 33/00*** | (2006.01) |

(52) U.S. Cl.
CPC ..... *F41A 9/70* (2013.01); *F41A 33/00* (2013.01)

(58) Field of Classification Search
CPC ..... F41A 9/65; F41A 9/70; F41A 9/71
USPC ..... 42/49.02
See application file for complete search history.

(56) References Cited

U.S. PATENT DOCUMENTS

| | | | | |
|---|---|---|---|---|
| 2,296,729 | A | 9/1942 | Mossberg | |
| 2,355,045 | A | 8/1944 | Audet | |
| 3,465,463 | A | 9/1969 | Grandy et al. | |
| 4,139,959 | A | 2/1979 | Howard | |
| 4,777,752 | A | 10/1988 | Howard | |
| 5,345,660 | A | 9/1994 | Howard | |
| 8,434,254 | B1 | 5/2013 | Watchorn et al. | |
| 9,784,512 | B1 * | 10/2017 | Harding | F41A 9/70 |
| 2011/0005115 | A1 | 1/2011 | Cahill | |
| 2015/0101228 | A1 | 4/2015 | Giannini et al. | |
| 2015/0241162 | A1 | 8/2015 | Geraghty et al. | |

* cited by examiner

*Primary Examiner* — Reginald S Tillman, Jr.
(74) *Attorney, Agent, or Firm* — DLA Piper LLP (US)

(57) ABSTRACT

Systems and methods herein relate to a safety magazine for blank ammunition or "blanks". In one illustrative implementation, a specially-shaped follower is utilized to engage and advance the blank ammunition without jamming, i.e., when holding and feeding blank cartridges into the chamber of a firearm. In other implementations, integrated/unitary magazines including such a follower are disclosed, which also prevent jams otherwise common in the field of magazines converted to handle blank rounds of ammunition. According to such implementations, live ammunition or cartridges are prevented from being loaded into the magazine and a specialized follower that prevents the ammunition form jamming is provided.

17 Claims, 28 Drawing Sheets

FOLLOWER FOR BLANK CARTRIDGES, UNITARY/INTEGRATED MAGAZINE WITH FOLLOWER, AND METHODS FOR MANUFACTURING SAME

CROSS REFERENCE TO RELATED APPLICATIONS

This patent application is a continuation of U.S. Utility patent application Ser. No. 15/349,579 filed on 11 Nov. 2016, which is a continuation of U.S. utility patent application Ser. No. 14/789,951 filed on 1 Jul. 2015, which claims priority from U.S. provisional patent application No. 62/019,858 filed 1 Jul. 2014; this application also bears relation to U.S. utility patent application Ser. No. 14/182,600 filed 18 Feb. 2014, and U.S. provisional patent application No. 61/770,458 filed on 28 Feb. 2013; all of which are herein incorporated by reference in their entirety.

BACKGROUND

Field

The innovations herein relate to a safety magazine, and more particularly, to a specialized follower and integrated/unitary magazine with such follower that prevent jams, i.e., when holding and feeding blank cartridges into the chamber of a firearm.

Description of Related Information

Firearms magazines have been developed for their intended caliber and cartridge length to be held in a specific arrangement and presented to the firearm chamber through various firearm receiver actions. Further, blank cartridges, which are a type of cartridge for a firearm that contains gunpowder but no bullet or shot, are commonly used for simulation in training (such as military or police training), signaling, or theatrical/movie special effects wherein a sound or flash is needed but a projectile would not be safe. In a military application, soldiers typically train using the same rifle magazine for firing live cartridges (such as in firing ranges) as they do for blank ammunition (such as in urban training). This dual usage results in two debilitating outcomes for military personnel.

First, during training exercises, the blank ammunition often "jams" causing the service rifle to malfunction. Unfortunately, this jamming is virtually inevitable when using the same rifle magazine for firing live cartridges as for blank ammunition as the standard-issue magazine was never designed to fire blank ammunition. As everyone in uniform knows, the much shorter blank ammunition cartridges simply do not feed properly from the standard magazine into the service rifle. As a result, realism is sacrificed and valuable training time is lost.

Second, dual usage eventually results in the unfortunate situation wherein live cartridges may become mixed with blank cartridges, thereby seriously hurting or killing soldiers or anyone else in the vicinity.

Currently, there are no magazines that accept only blank cartridges and prevent live cartridges from being loaded into the magazine, thereby preventing the aforementioned pitfalls of current firearm magazines.

BRIEF DESCRIPTION OF THE DRAWINGS

The following description should be read with reference to the drawings, in which like elements in different drawings are numbered in like fashion. The drawings, which are not necessarily to scale, depict selected embodiments and are not intended to limit the scope of the disclosure. The disclosure may be more completely understood in consideration of the following detailed description of various embodiments in connection with the accompanying drawings, in which.

DETAILED DESCRIPTION

Figure 1:
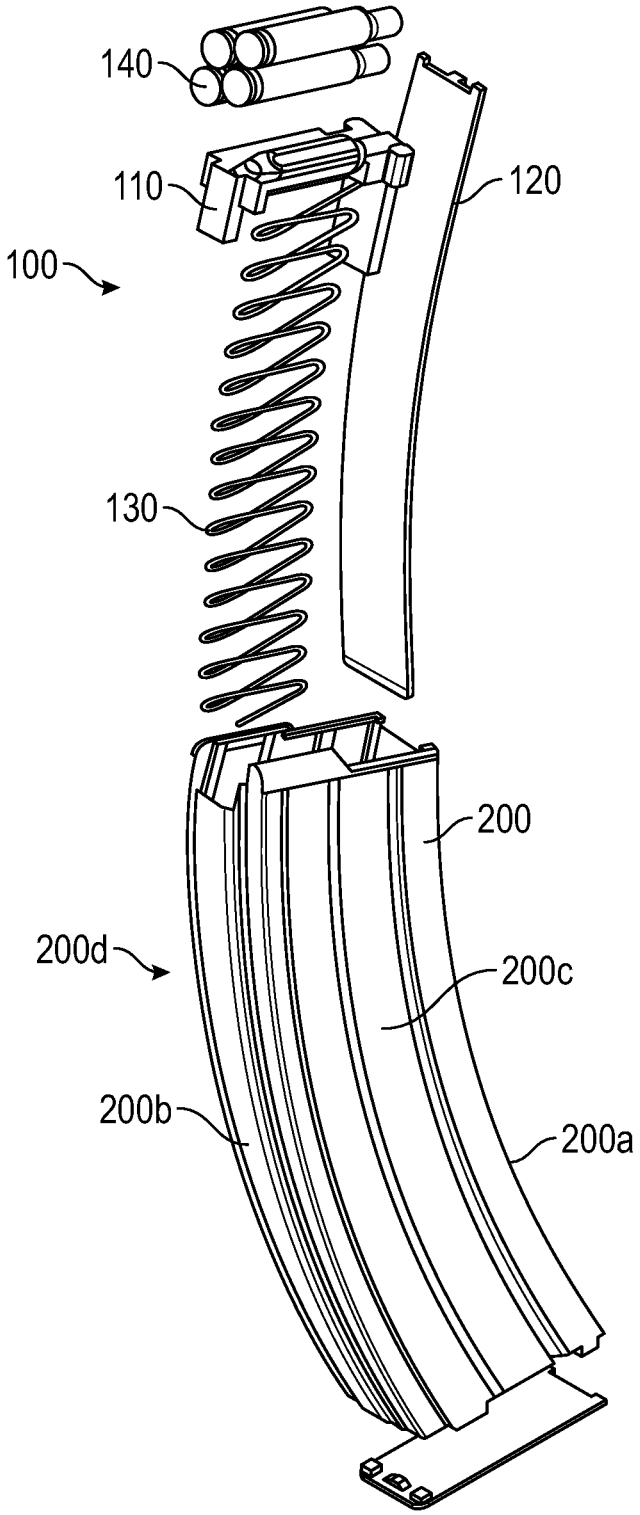
FIG. 1 illustrates an exploded view of the blank cartridge magazine and its internal components consistent with one or more aspects of the innovations herein.

In the Summary of the Invention above and in the Detailed Description, and the claims below, and in the accompanying drawings, reference is made to particular features (including method steps) of the invention. It is to be understood that the disclosure of the invention in this specification includes all possible combinations of such particular features. For example, where a particular feature is disclosed in the context of a particular aspect or embodiment of the invention, or a particular claim, that feature can also be used, to the extent possible, in combination with and/or in the context of other particular aspects and embodiments of the invention, and in the invention generally. The term "comprises" and grammatical equivalents thereof are used herein to mean that other components, ingredients, steps, etc. are optionally present. For example, an article "comprising" (or "which comprises") components A, B, and C can consist of (i.e., contain only) components A, B, and C, or can contain not only components A, B, and C but also one or more other components. Where reference is made herein to a method comprising two or more defined steps, the defined steps can be carried out in any order or simultaneously (except where the context excludes that possibility), and the method can include one or more other steps which are carried out before any of the defined steps, between two of the defined steps, or after all the defined steps (except where the context excludes that possibility).

The term "at least" followed by a number is used herein to denote the start of a range beginning with that number (which may be a range having an upper limit or no upper limit, depending on the variable being defined). For example "at least 1" means 1 or more than 1. The term "at most" followed by a number is used herein to denote the end of a range ending with that number (which may be a range having 1 or 0 as its lower limit, or a range having no lower limit, depending upon the variable being defined). For example, "at most 4" means 4 or less than 4, and "at most 40%" means 40% or less than 40%. When, in this specification, a range is given as "(a first number) to (a second number)" or "(a first number)–(a second number)," this means a range whose lower limit is the first number and whose upper limit is the second number. For example, 25 to 100 mm means a range whose lower limit is 25 mm, and whose upper limit is 100 mm.

The embodiments set forth below represent the necessary information to enable those skilled in the art to practice the invention and illustrate the best mode of practicing the invention. In addition, the invention does not require that all the advantageous features and all the advantages need to be incorporated into every embodiment of the invention. Upon reading the following description in light of the accompanying drawing figures, those skilled in the art will understand the concepts of the invention and will recognize applications of these concepts not particularly addressed herein. It should be understood that these concepts and applications fall within the scope of the disclosure and the accompanying claims.

Overview

The present document addresses the aforementioned deficiencies of current magazines by disclosing a blank cartridge magazine that prevents live ammunition or cartridges from being loaded into the magazine and a specialized follower that prevents the ammunition from jamming.

Disclosed here are innovative, M16/M4 5.56 training magazine specifically designed to fire blank ammunition. Our blank-fire magazines feed blanks into the service rifle seamlessly without causing jams. And, our blank-fire magazine requires absolutely no modifications to the rifle and costs the same as a regular magazine. Perhaps most importantly, the blank-fire magazine makes training safer because it is simply impossible to load live rounds into our magazine.

In order to prevent the loading of only blank cartridges, and not live cartridges with projectiles, the systems here embody a standard sized magazine, for whichever kind of firearm is used, and prevent the loading of live ammunition while also aiding in the prevention of jams, where a round is stuck in the magazine and is unable to properly load into the receiver group.

Currently, blank cartridges are differentiated from live cartridge in that they have a shorter length because they do not have a projectile or bullet at their head end, but rather comprised of a casing having gunpowder and a primer and wherein the head end area is crimped.

EXAMPLES

FIGS. 1-10 illustrate an example embodiment of the blank cartridge magazine. FIG. 1 illustrates an exploded view of the embodiment of the magazine 100 for blank rifle cartridge or ammunition. The magazine comprises a housing 200 having a front wall 200*a* and rear wall 200*b* and right side wall 200*c* and left side wall 200*d*. Housing 200 further include an end or floor plate 210 [label] attached thereto which receives a distal end of a follower spring 130. The floor plate 210 encloses the lower end of housing 200 to define, along with the side walls and front and back walls, an interior space sufficient to retain any desired number of cartridges 140. The magazine further receives within its housing 200 a cartridge follower 110 for holding blank ammunition or blank cartridges 140 and for guiding them upwards through the housing 200 after rounds are ejected from the magazine into the firearm receiver group. A proximal end of biased spring 130 further attaches to the bottom surface of follower 110. The magazine further receives slide insert 120 within its interior that is positioned adjacent the front wall 200*a*, as further shown in FIG. 5-6. In certain example embodiments as will be discussed below, the slide insert 120 may be removable, attached to the front wall 200*a* or side walls 200*c* 200*d* by any example adhesion including but not limited to weld, rivet, glue, and/or friction. In certain examples of the invention, the magazine front wall has a thickness greater than that of the rear wall. The thickness of the front wall is fixed and formed integral with the front wall and is not removable and is not a sliding member that may be interchanged. Instead, the thickness of the front wall may be increased, for example, by welding and/or riveting or by any other means to permanently attach a structural element to the front wall to increase the thickness of the front wall, or by using a thicker material to make the thicker wall. The front wall having a thickness greater than that of a rear wall where the thickness of the front wall does not change increases the safety of the magazine in that the user is assured that the magazine is physically incapable of accepting live ammunition. A front wall that is not fixed and increased/decreased in thickness by one or more slideable/replaceable members may allow loading of live ammunition when the slideable/replaceable member is inadvertently removed from the magazine. However, a front wall having a fixed, permanent thickness in that the front wall may not be disassembled or manipulated to change the thickness of the front wall increases the reliability and effectiveness of the magazine. In this manner, non-projectile ammunition, such as blank ammunition, can be loaded while live projectile ammunition including the ball/projectile/bullet are prevented from loading.

Still referring to FIG. 1, housing 200 can be may be made of any suitable material metal, titanium, aluminum, steel, or polymer. Further, housing 200 may be integrally formed from sheet metal and folded into the final configuration as shown. The distance between the housing 200 front wall 200*a* and rear wall 200*b* may correspond generally to and be slightly greater than the length of the blank cartridges 140 to be stored. It should be noted that the dimensions of the magazine housing 200 and the cartridges to be loaded into the housing 200 could vary depending on the caliber of round and type of firearm it is intended to be used with. The examples in this description generally use the dimensions of a standard M-16 using a 5.56 mm caliber round. However, the general descriptions and embodiments described here could be adopted to any kind of magazine, used in any type of firearm, including hand guns, as well as rifles and long barreled firearms.

It is contemplated within the scope of the invention that the internal components of the magazine 100, such as follower 110, slide insert 120, and spring 130 can either be manufactured and assembled with housing 200 and the housing or any of the aforementioned components can be color coded, labeled, or have indicia indicating that the magazine is for blank ammunition. Alternatively, follower 110, slide insert 120, and spring 130 can be retrofitted with existing magazine housings of rifles that fire live ammunition. Specifically, the internal components of a live ammunition magazine, such as an M16 or M4 rifle, can be replaced with the internal components of the present invention, such as follower 110, slide insert 120, and spring 130. Further, the components of the present solution, such as the follower, slide insert, and spring can be insertable into a standard M16 style magazine well, wherein the safety magazine is adapted for enabling non-lethal training cartridges to be fired while preventing the loading and firing of standard 5.56×45 mm NATO cartridges.

Figure 2:
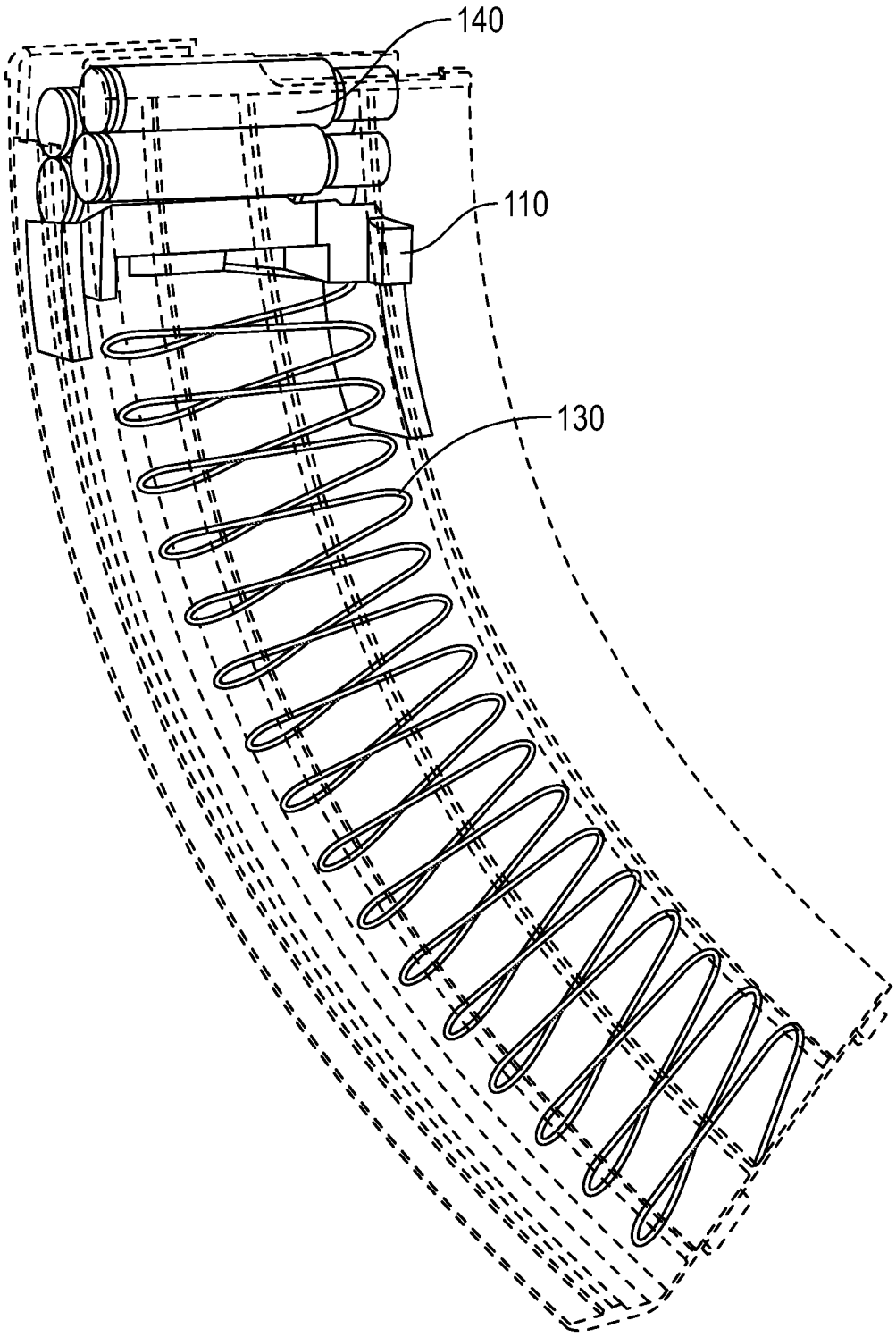
FIG. 2 illustrates a perspective view of the internal components of the blank cartridge magazine, as assembled, consistent with one or more aspects of the innovations herein.

FIG. 2 shows the spring 130 pushing the cartridge follower 110 up in the main body of the magazine housing 200. The example in FIG. 2 also shows the blank cartridges loaded 140. The slide insert 120 from FIG. 1 takes up the space where the projectile on a live round would extend past the cartridge jacket.

Figure 3:
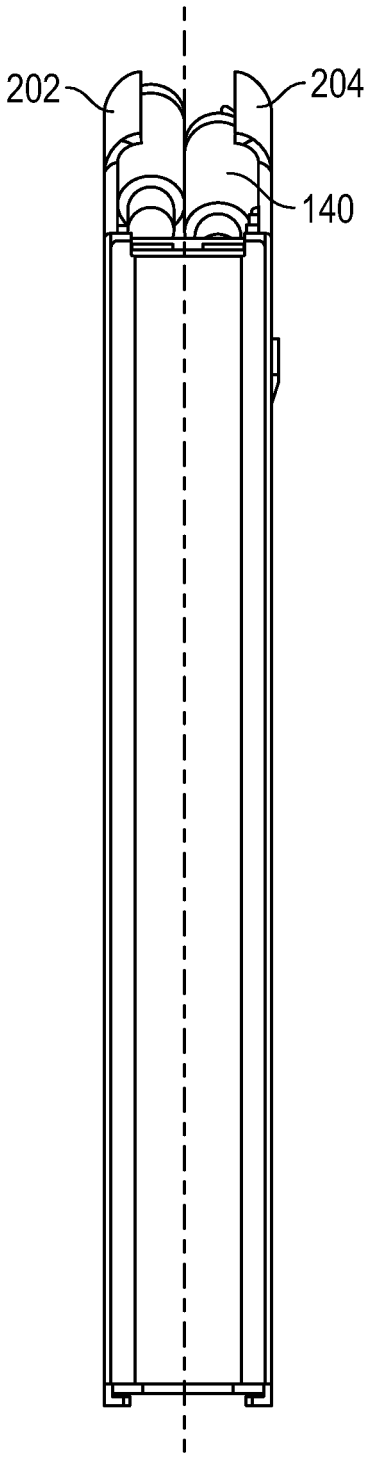
FIG. 3 illustrates a front view of the blank cartridge magazine, as assembled, consistent with one or more aspects of the innovations herein.

Referring now to FIG. 3, showing a front on view of the magazine, loaded with blank rounds 140, a pair of feed lips 202 and 204 are positioned on the upper edges of the side walls to single feed the cartridges into receiver group (not pictured).

Figure 4:
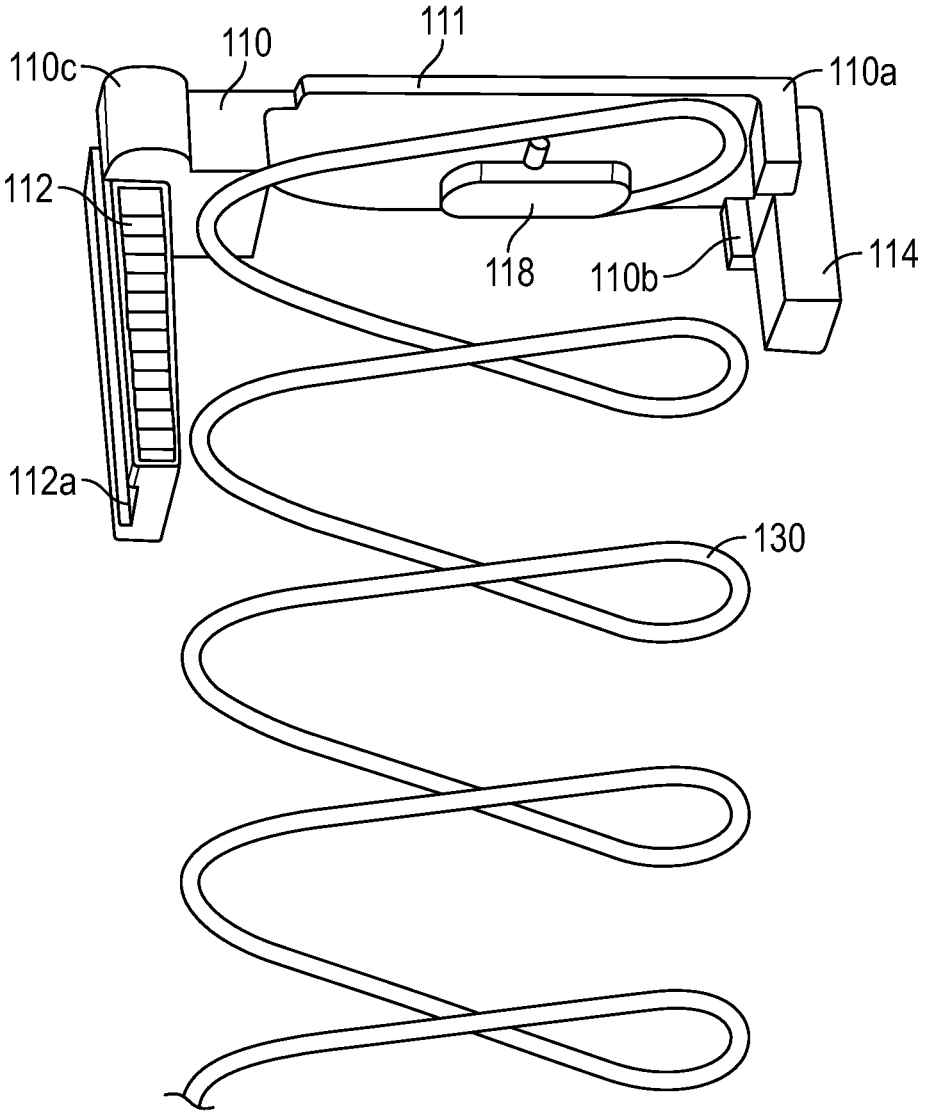
FIG. 4 illustrates an underside perspective view of a cartridge follower and spring of the blank cartridge magazine consistent with one or more aspects of the innovations herein.

FIG. 4 shows an example of the cartridge follower 110 and the spring 130 without the magazine housing shown. The cartridge follower 110 may be made of a heat resistant molded polymer, metal, ceramic, or other suitable material. Further, spring 130 and floor plate 210 may have corresponding projections or recesses to locate an end of the spring at a desired location with respect to the housing floor.

Still referring to FIG. 4, cartridge follower 110 has a main body plate 111 having a detent projection 118 underneath it for receiving a first end of spring 130. Further, a first elongated projection or guide 114 extends downward from main body 111 of cartridge follower 110, wherein the guide 114 can be attached to the main body 111 separately or formed integrally with main body 111. Guide 114 assists the guiding of cartridge follower 110 within the magazine housing 200 as the cartridge follower 110 moves up and down in the magazine housing, depending on how many cartridge rounds are loaded in it. In the example embodiment, first guide 114 is position adjacent to the interior surface of rear wall 200*b*, thereby allowing and guiding the follower along the length of the rear wall 200*b*. However, it is contemplated within the scope of the invention that guide 114 can also be configured to be position adjacent to the interior of front wall 200*a* of the magazine. Here, guide 114 is substantially perpendicular with respect to the top surface (surface contacting the cartridge) of main body 111 and is further reinforced by a pair of protrusions 110*a* and 110*b* that further assist the guiding of follower 110 within the walls of housing 200 when it is positioned in and moves up and down within the housing.

On the opposing side of cartridge follower 110, is an elongated second protrusion or guide 112, wherein second guide 112 can be attached separately to main body 111 or formed integrally with main body 111 of the cartridge follower 110. Second guide 112 assists the guiding of follower 110 within housing 200 as explained above. In the example embodiment, second guide 112 is position adjacent to a slide insert 120 (from FIG. 1) that is positioned adjacent to the interior surface of front wall 200*a*, thereby allowing and guiding the follower along the length of slide insert 120 and front wall 200*a*. However, it is contemplated within the scope of the invention that guide 112 can also be configured to be position adjacent to the interior of rear wall 200*b* of the magazine.

In the example of FIG. 4, guide 112 is substantially perpendicular with respect to the top surface (surface contacting the blank cartridge) of main body 111 and is further reinforced by a block 110*c* having opposing lobed protrusions that further assist the guiding of the follower 110 within the walls of housing 200. In the example shown, second guide 112 is slightly longer in length as it extends into the magazine housing and away from the cartridge follower 110 than first guide 114. Further, second guide 112 can also include an elongated recess or channel 112*a* that can further engage an elongated projection or track in the magazine housing (not shown) along insert 120 in another embodiment of the invention, thereby assisting in positioning and movement within the magazine along slide insert 120. Alternatively, in another embodiment, channel 112*a* can also engage any track or elongated projection along the interior of the front or rear walls of the housing 200.

Figure 5:
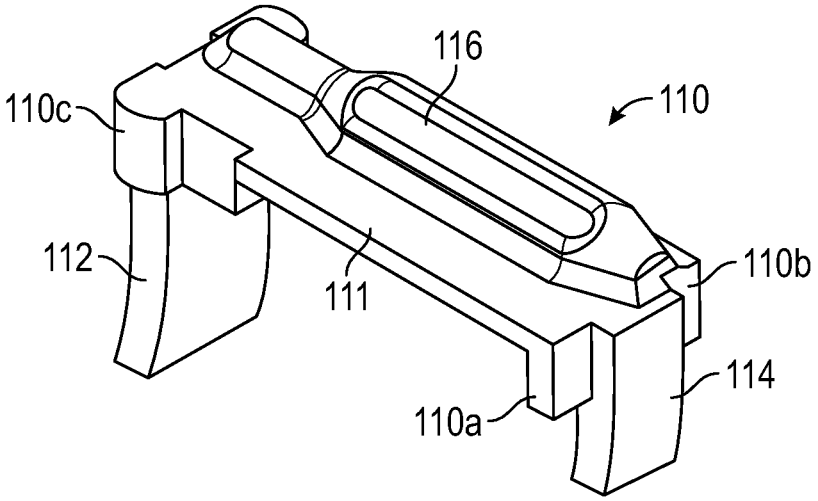
FIG. 5 illustrates a perspective view of the cartridge follower consistent with one or more aspects of the innovations herein.

FIGS. 5-8 illustrate the cartridge follower 110 in various orientations. FIG. 5 shows a top perspective with a blank cartridge mold 116 in the main body 111 of the cartridge follower 110. The first guide 114 and second guide 112 are also shown.

Figure 6:
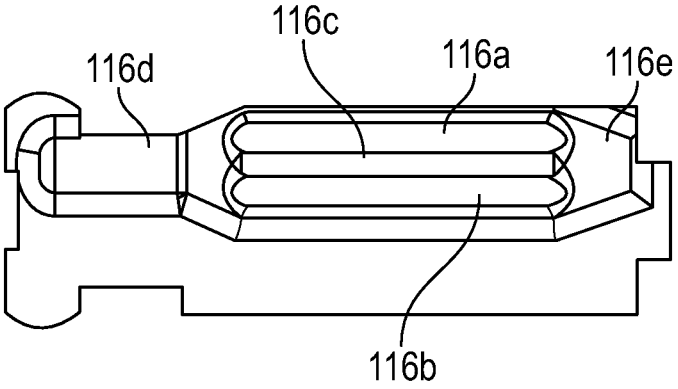
FIG. 6 illustrates a top view of the cartridge follower consistent with one or more aspects of the innovations herein.

FIG. 6 shows a detail top down view embodiment of the blank cartridge mold 116 in the cartridge follower 110. In this detail, the blank cartridge has various bulges 116*a* 116*b* 116*c* running the length of the blank cartridge mold body 116. The front includes a ridge 116*d* that mimics a projectile and follows the contour of a cartridge front section. The rear 116*e* includes a tapered section. Here, grooves 116*a* and 116*b* can be concave or convex in configuration. In addition, mold 116 has a peak area or ridge 116*c*. It is contemplated within the scope of the invention that mold 116 can be situated on side on the top surface of the main body 111. Further, it is contemplated within the scope of the invention that mold 116 can be integrated with the main body of follower 110 or can be separately be affixed to or attached to the main body 111. Also, it is contemplated within the scope of the invention that the cartridge mold can be of any length, configuration, shape, or dimension.

Figure 7:
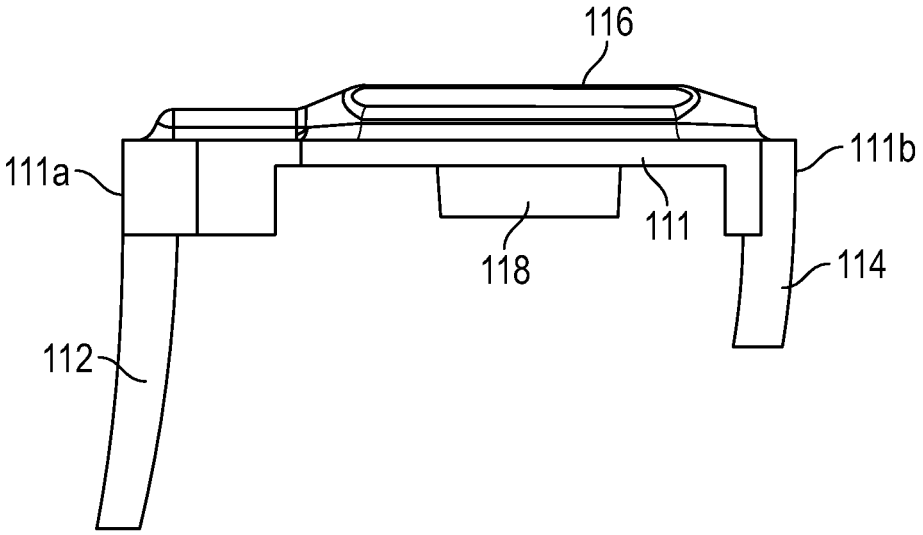
FIG. 7 illustrates a side view of the cartridge follower consistent with one or more aspects of the innovations herein.

FIG. 7 shows the main body 111 of cartridge follower 110 with a front end 111*a*, rear end 111*b*. FIG. 7 also shows the first guide 114 and second guide 112 extending form the cartridge follower main plate body 111.

Figure 8:
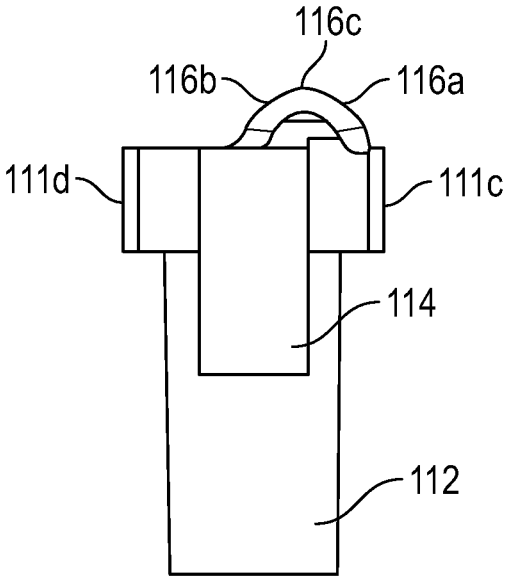
FIG. 8 illustrates a rear view of the cartridge follower consistent with one or more aspects of the innovations herein.

FIG. 8 shows the cartridge follower 110 with a right side end 111*c*, and left side end 111*d*. Further, main body 111 includes a projected blank cartridge mold 116. Here, the blank cartridge mold 116 is approximately one-half of a simulated blank cartridge and having similar dimensions of a blank cartridge. This blank cartridge mold 116 mimics a cartridge when the other cartridges are loaded into the magazine and the cartridge follower is depressed into the magazine.

Cartridge mold 116 allows a user to quickly see that the magazine is for a blank cartridge and not live cartridges prior to loading the magazine. In addition, mold 116 allows the stack of cartridges 140 to be slightly offset from each other when stacked within the housing, thereby allowing each individual cartridge to be fed through the feed lips and further prevent jamming of the firearm.

Figure 9:
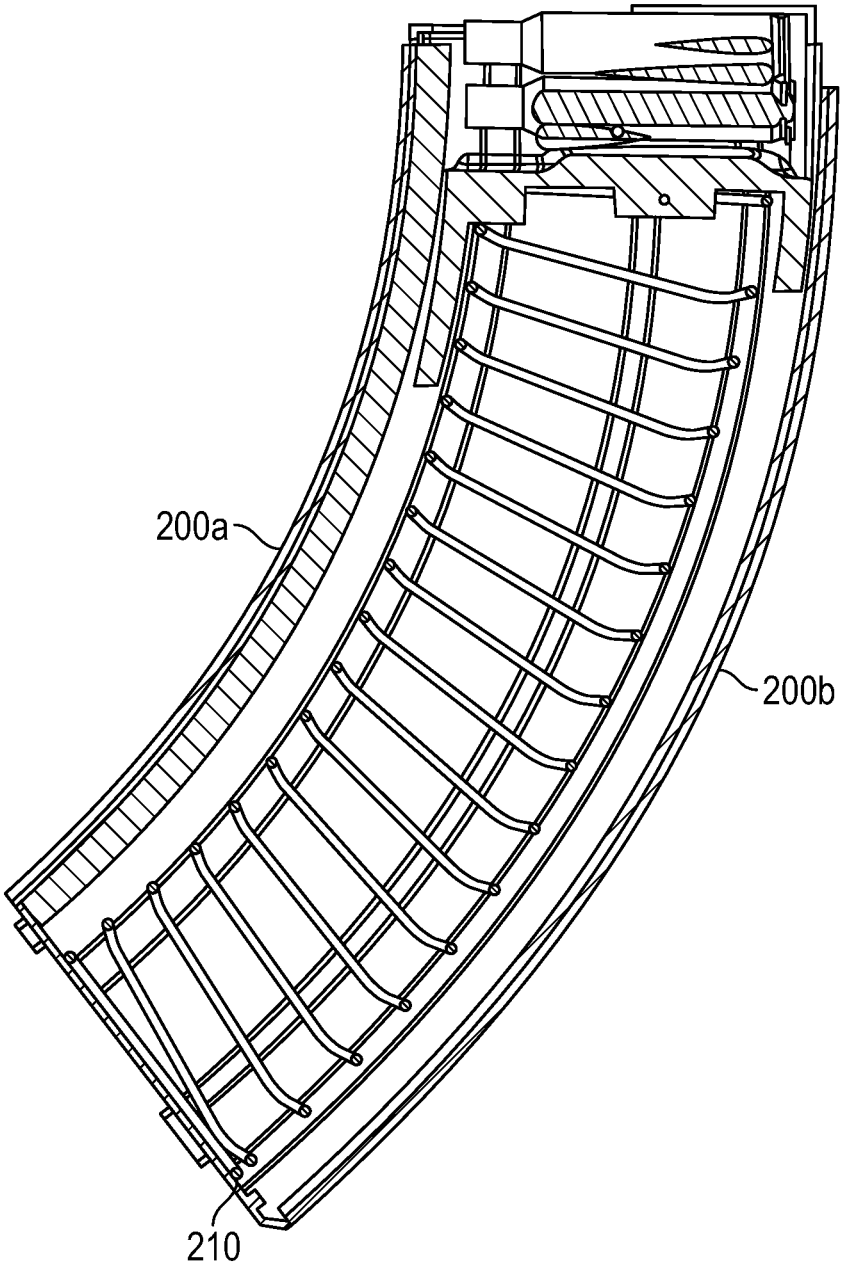
FIG. 9 illustrates a cross-sectional side view of the blank cartridge magazine, as assembled consistent with one or more aspects of the innovations herein.
Figure 10:
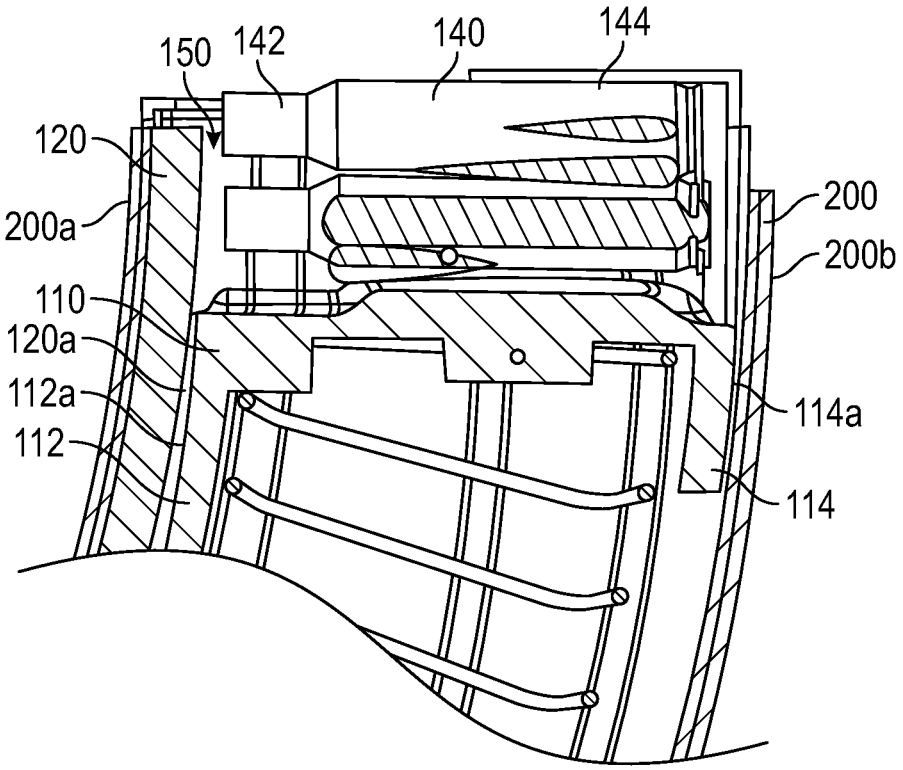
FIG. 10 illustrates a close-up section side view of the upper area of the blank cartridge magazine, as assembled consistent with one or more aspects of the innovations herein.

FIGS. 9 and 10 show detail cut away views of the cartridge housing 200. FIG. 9 shows the front 200*a* and rear 200*b* walls of the housing 200 as well as the floor plate 210. FIG. 10 shows a close up detail of the top of the magazine housing 200 where the cartridges are fed into the firearm receiver group (not shown). The cartridge 140 is shown with a cartridge body 144 and a narrower front 142 where a projectile would protrude if there was one as in a live round. But instead, in this example, a slide insert 120 is shown in the magazine housing 200 which restricts loading cartridges that have projectiles 150. FIG. 10 also shows details of a front guide 112, channel 112*a*, second guide 114 and second channel 114*a* that may position the cartridge follower as it rides up and down within the magazine housing.

Figure 11:
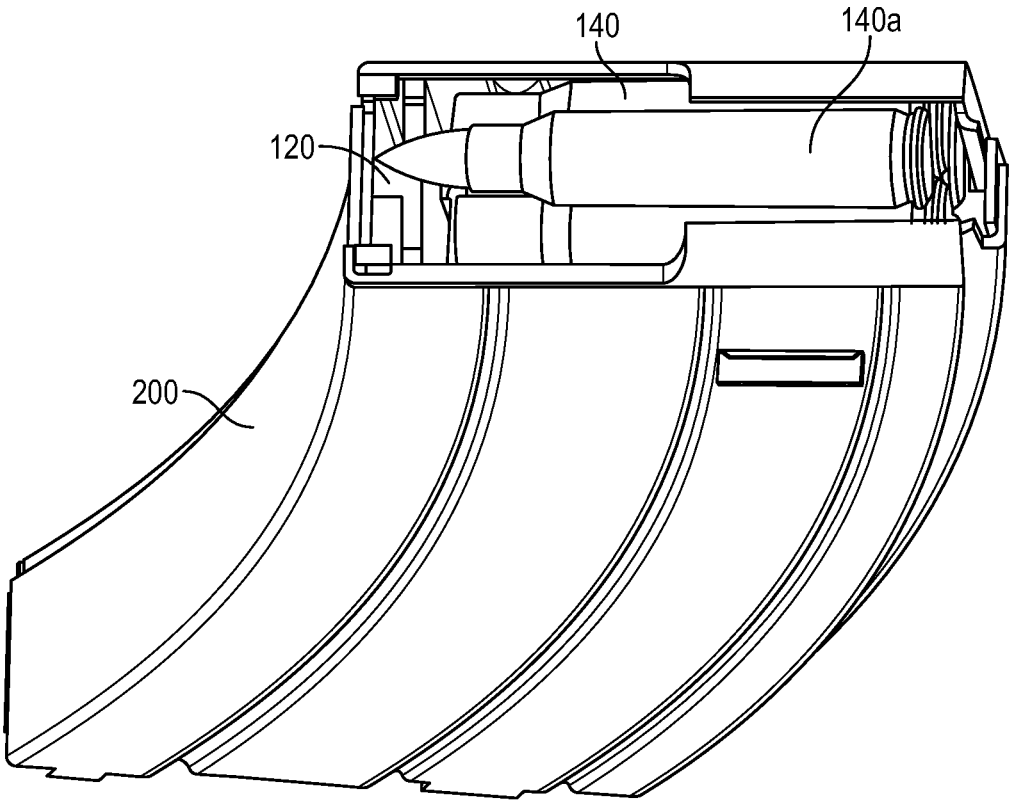
FIG. 11 illustrates a perspective top view of the blank cartridge magazine, showing loaded blank cartridges and prevented loading of a live cartridge consistent with one or more aspects of the innovations herein.
Figure 12:
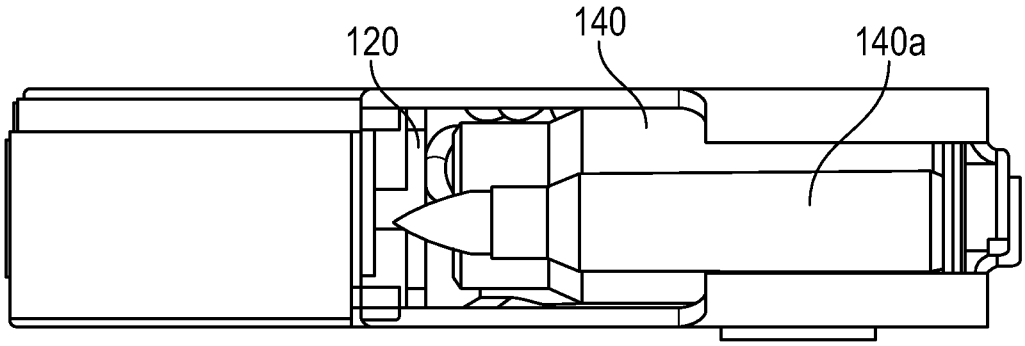
FIG. 12 illustrates a top view of the blank cartridge magazine, showing loaded blank cartridges and prevented loading of a live cartridge consistent with one or more aspects of the innovations herein.

FIGS. 11-12 illustrate an embodiment of the invention wherein a live ammunition cartridge 140*a* is shown in the magazine which can only accommodate blanks. Thus, because the live round includes a projectile end, the slide insert 120 prevents the live round from being inserted into the housing 200.

Figure 14:
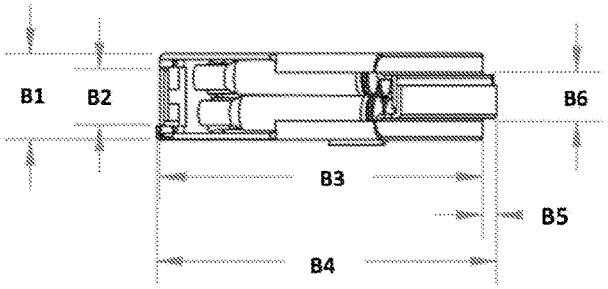
FIG. 14 illustrates a top view of a housing of the blank cartridge magazine consistent with one or more aspects of the innovations herein.
Figure 13:
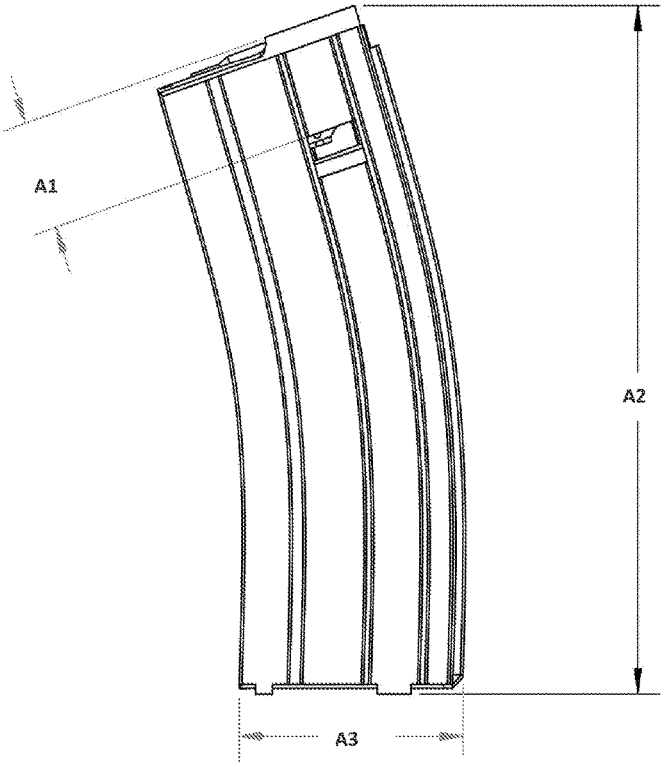
FIG. 13 illustrates a side view of a housing of the blank cartridge magazine consistent with one or more aspects of the innovations herein.
Figure 15:
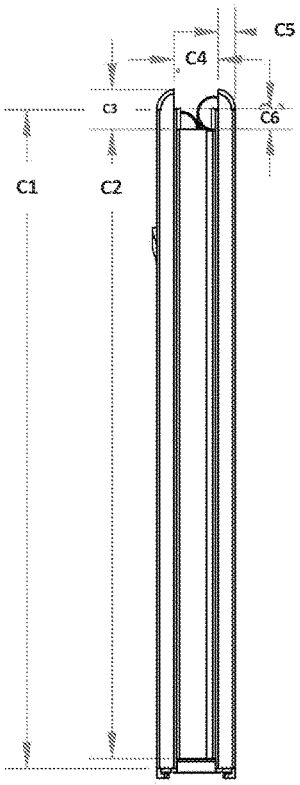
FIG. 15 illustrates a front or rear view of a housing of the blank cartridge magazine consistent with one or more aspects of the innovations herein.
Figure 16:
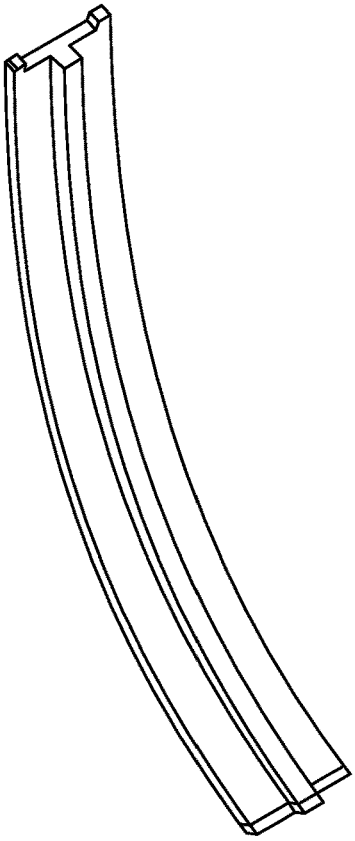
FIG. 16 illustrates a perspective view of a slide spacer insert consistent with one or more aspects of the innovations herein.
Figure 17:
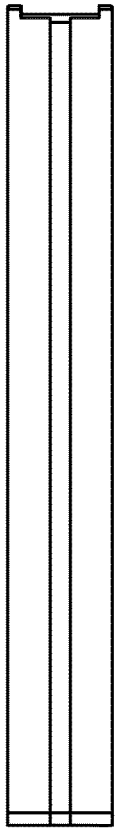
FIG. 17 illustrates a front view of the slide spacer insert consistent with one or more aspects of the innovations herein.
Figure 18:
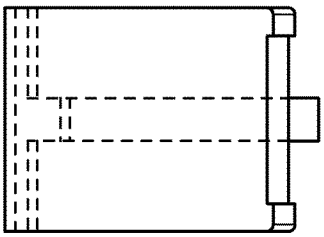
FIG. 18 illustrates a top view of the slide spacer insert consistent with one or more aspects of the innovations herein.
Figure 19:
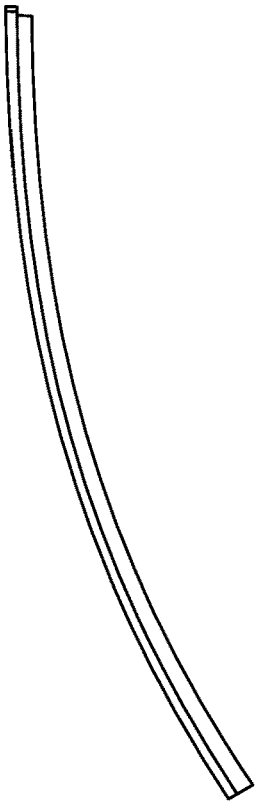
FIG. 19 illustrates a side view of the slide spacer insert consistent with one or more aspects of the innovations herein.
Figure 20:
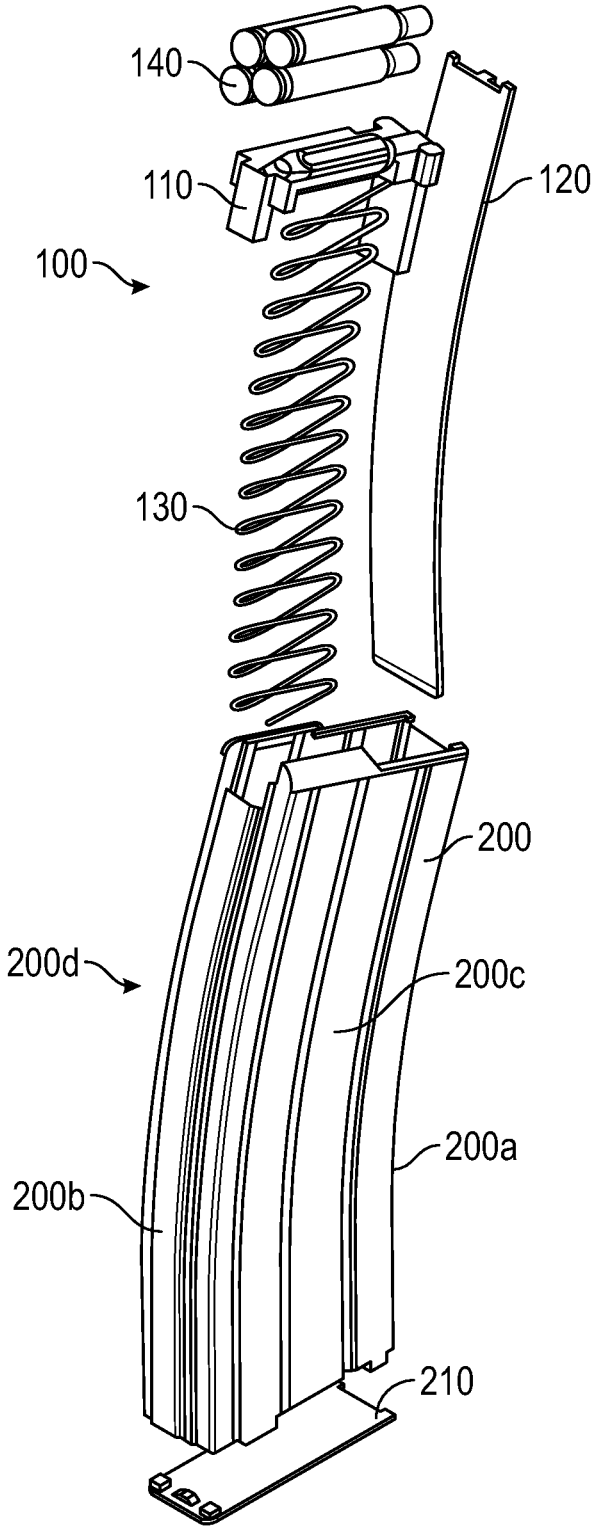
FIG. 20 illustrates an exploded view of the blank cartridge magazine and its internal components consistent with one or more aspects of the innovations herein.
Figure 21:
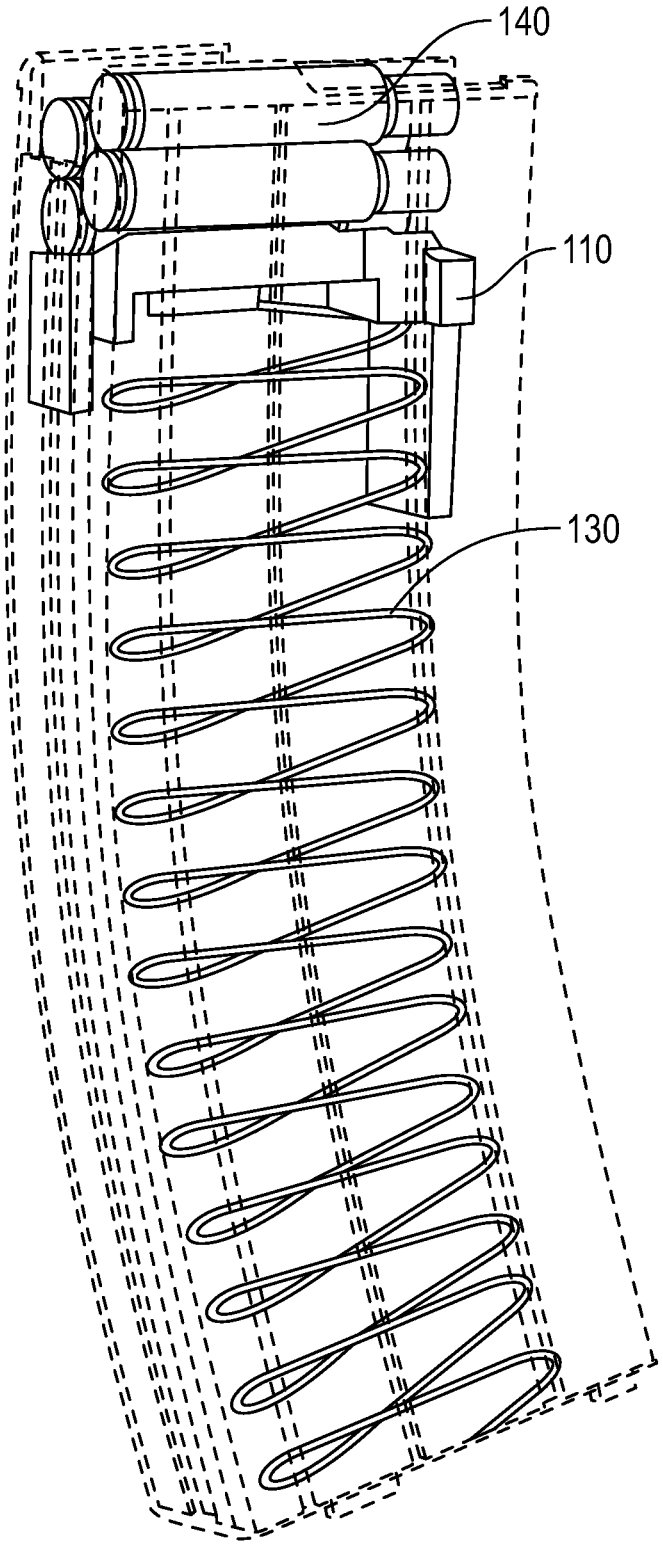
FIG. 21 illustrates another perspective view of the internal components of the blank cartridge magazine, as assembled, consistent with one or more aspects of the innovations herein.
Figure 22:
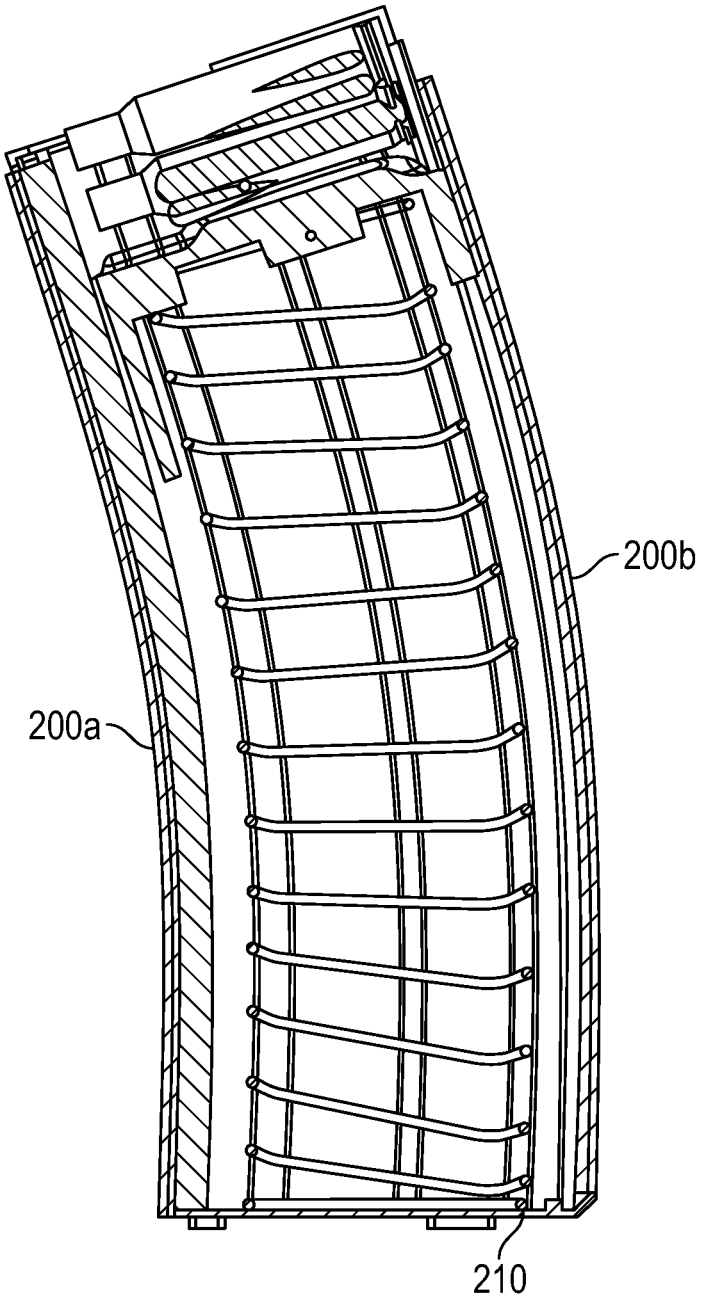
FIG. 22 illustrates yet another perspective view of the internal components of the blank cartridge magazine, as assembled, consistent with one or more aspects of the innovations herein.

FIGS. 13-15 illustrate an example embodiment for a magazine housing 200 holding the blank cartridges of the present solution. In particular, a range and preferred measurements for the housing will now be described with references to numerals [insert figs with the following numbering into drawing set] A1-A3, B1-B6, and C1-C5, wherein the measurements/dimensions can be approximations (approx.) and referred to herein in inches (in. or in). Here, A1 can be approx. 1 in., preferably 1.12. A2 can be approx. 7 in., preferably 7.06 in. A3 can be approx. 2-3 in., preferably 2.52 in. B1 can be approx. 0.5-1 in., preferably 0.87 in. B2 can be approx. 0.5 in., preferably 0.58 in. B3 can be approx. 3 in., preferably 3.29 in. B4 can be approx. 3 in., preferably 3.47 in., B5 can be approx. 0.1 in., preferably 0.14 in. B6 can be approx. 0.4-0.6 in., preferably 0.50 in. C1 can be approx. 6 in., preferably 6.75 in. C2 can be approx. 6 in., preferably 6.45 in. C3 can be approx. 0.3-0.5 in., preferably 0.41 in. C4 can be approx. 0.3-0.4 in., preferably 0.50 in. C5 can be approx. 0.1-0.3 in., preferably 0.19 in. C6 can be approx. 0.1-0.3 in., preferably 0.21 in.

FIGS. 16-19 show perspective angles of the slide insert 120. The slide insert is contoured to follow the front wall of the magazine housing 200*a*. In various embodiments, the slide insert would be configured to slide into a magazine of whichever caliber and prevent a live round from being inserted.

FIGS. 20-23 and 26-32 are more illustrations of perspective views of the internal components of the blank cartridge magazine, as assembled, consistent with one or more aspects of the innovations herein.

Figure 23:
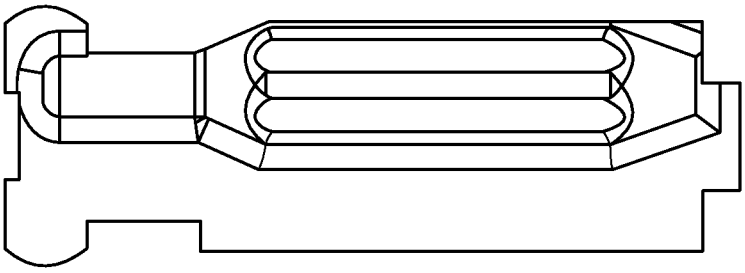
FIG. 23 illustrates a top view of the cartridge follower in another embodiment consistent with one or more aspects of the innovations herein.
Figure 24:
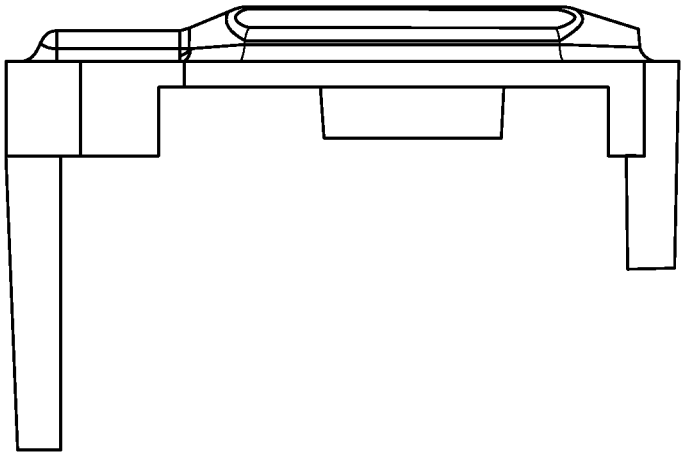
FIG. 24 illustrates a side view of cartridge follower consistent with one or more aspects of the innovations herein.
Figure 25:
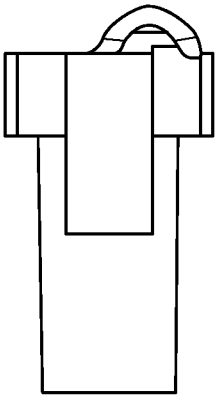
FIG. 25 illustrates a rear view of the cartridge follower consistent with one or more aspects of the innovations herein.
Figure 26:
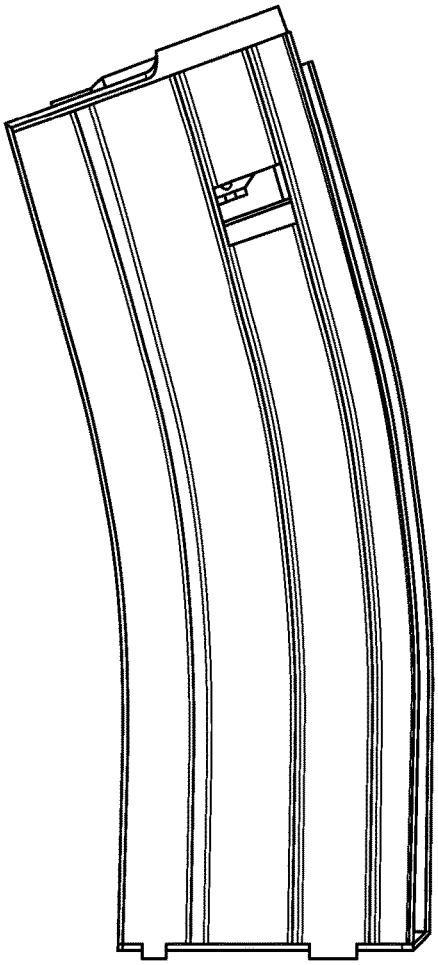
FIG. 26 illustrates a side view of a housing of the blank cartridge magazine consistent with one or more aspects of the innovations herein.
Figure 27:
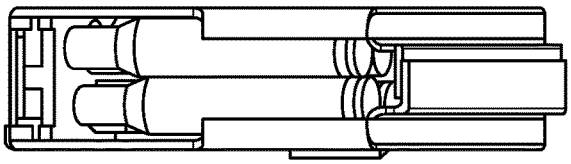
FIG. 27 illustrates a top view of a housing of the blank cartridge magazine consistent with one or more aspects of the innovations herein.
Figure 28:
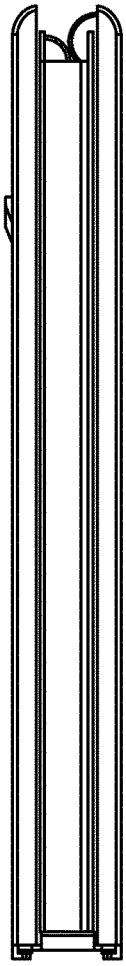
FIG. 28 illustrates a front or rear view of a housing of the blank cartridge magazine consistent with one or more aspects of the innovations herein.
Figure 29:
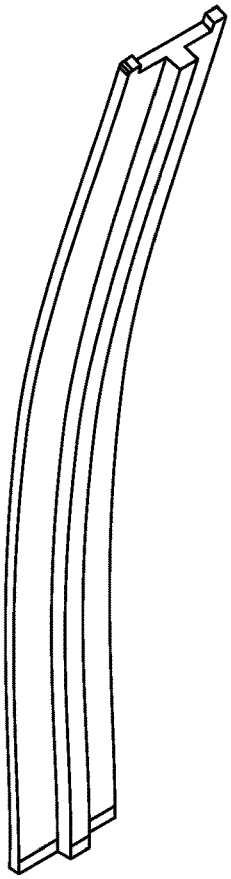
FIG. 29 illustrates a perspective view of a slide spacer insert consistent with one or more aspects of the innovations herein.
Figure 30:
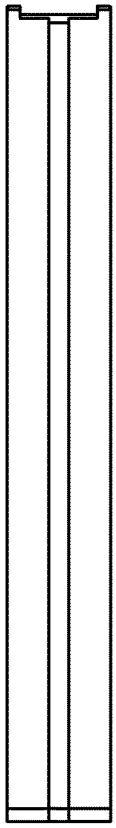
FIG. 30 illustrates a front view of the slide spacer insert consistent with one or more aspects of the innovations herein.
Figure 31:
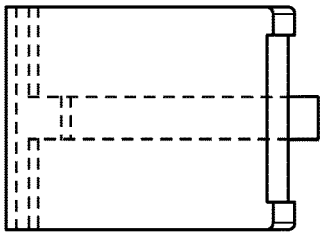
FIG. 31 illustrates a top view of the slide spacer insert consistent with one or more aspects of the innovations herein.
Figure 32:
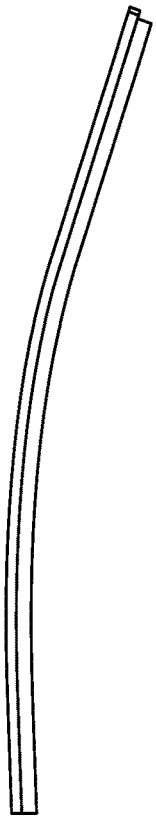
FIG. 32 illustrates a side view of the slide spacer insert consistent with one or more aspects of the innovations herein.

FIGS. 23-25 illustrate an example embodiment for a follower of the present solution. In particular, a range and preferred measurements for the housing will now be described with references to numerals D1-D12, E1-E11, and F1-F6, wherein the measurements/dimensions can be approximations (approx.) and referred to herein in inches (in. or in). Here, D1 can be approx. 0.1-0.3 in., preferably 0.20 in. D2 can be approx. R0.1-R0.3 in., preferably R0.17 in. D3 can be approx. 0.1-0.4 in., preferably 0.25 in. D4 can be approx. 0.1-0.4 in., preferably 0.24 in. D5 can be approx.

R0.1-R0.3 in., preferably R0.17 in. D6 can be approx. 0.2-0.4 in., preferably 0.33 in. D7 can be approx. 1-3 in., preferably 1.47 in. D8 can be approx. 1-3 in., preferably 1.27 in. D9 can be approx. 0.2-0.4 in., preferably 0.22 in. D10 can be approx. 0.2-0.4 in., preferably 0.32 in. D11 can be approx. 0.4-0.8 in., preferably 0.67 in. D12 can be approx. 0.1-0.3 in., preferably 0.18 in. E1 can be approx. 1-3 in., preferably 2.15 in. E2 can be approx. 0.5-4 in., preferably 1.24 in. E3 can be approx. 0.1-4 in., preferably 0.94 in. E4 can be approx. 0.05-0.3 in., preferably 0.14 in. E5 can be approx. 1-4 in., preferably 1.82 in. E6 can be approx. 0.05-0.3 in., preferably 0.17 in. E7 can be approx. 0.05 in-0.3 in., preferably 0.16 in. E8 can be approx. 0.1-0.5 in., preferably 0.35 in. E9 can be approx. 0.05-0.3 in., preferably 0.18 in. E10 can be approx. 0.1-4 in., preferably 0.66 in. E11 can be approx. 0.005-0.5 in., preferably 0.09 in. F1 can be approx. 0.2-1.5 in., preferably 0.76 in. F2 can be approx. 0.1-0.7 in., preferably 0.32 in. F3 can be approx. 0.1-0.4 in., preferably 0.22 in. F4 can be approx. 0.1-1.0 in., preferably 0.49 in. F5 can be approx. 0.1-4 in., preferably 1.24 in. F6 can be approx. 0.1-4 in., preferably 1.42 in.

FIGS. 33-37 illustrate an example additional or alternative embodiment of the invention of the firearm magazine.

Figure 33:
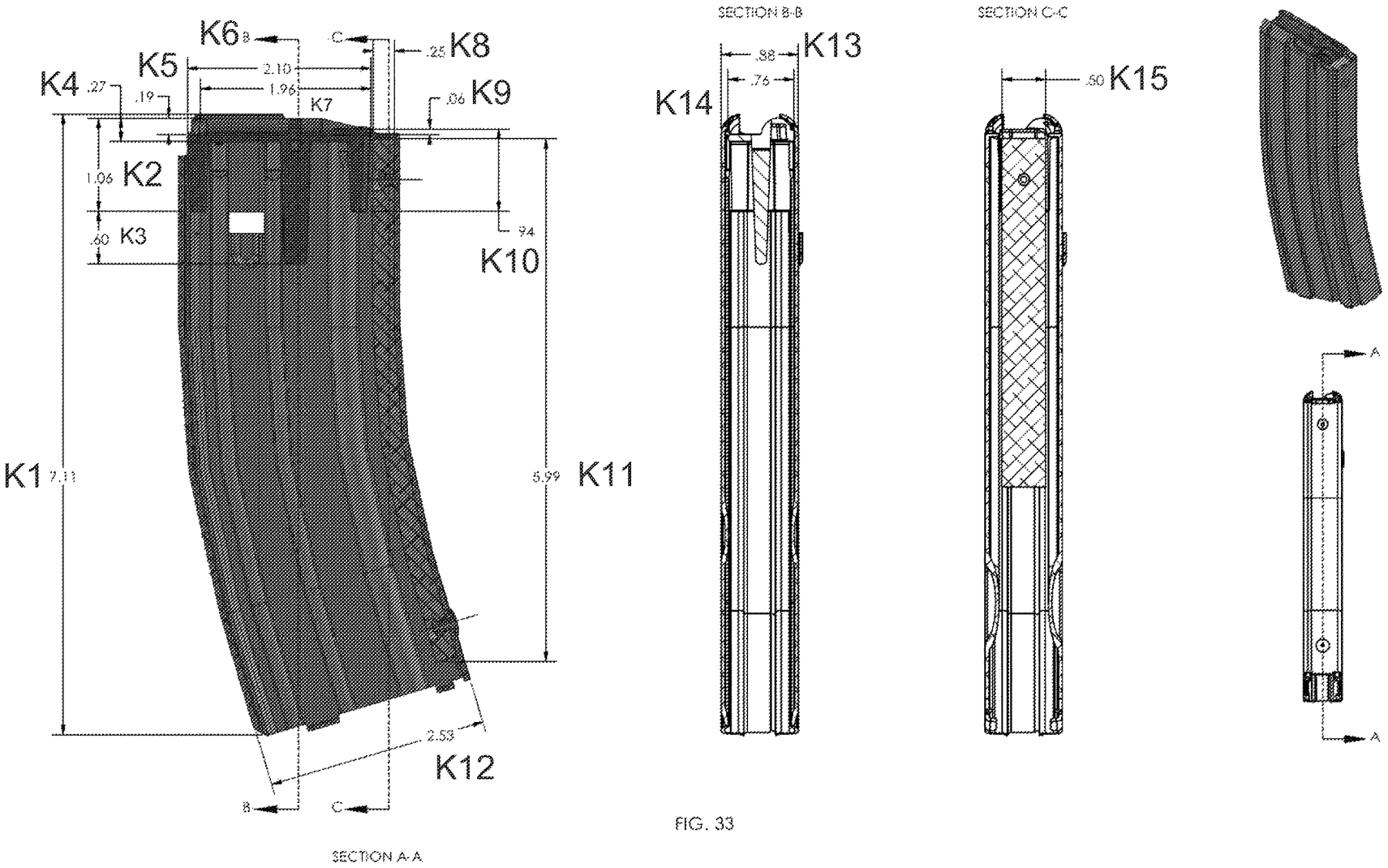
FIG. 33 illustrates different views of the magazine consistent with one or more aspects of the innovations herein.

FIG. 33 illustrates an implementation of the invention of the firearm magazine. In particular, measurements will now be described with references to numerals K1-K15, wherein the measurements/dimensions can be approximations (approx.) and referred to herein in inches (in. or in). Here, K1 can be approximately can be approx. 1-10 in., preferably 7.11 in. K2 can be approximately 0.01-3 in., and preferably 1.06 in. K3 can be approximately 0.01-3 in., and preferably approximately 0.60 in. K4 can be approximately 0.01-3 in., and preferably approximately 0.27 in. K5 can be approximately 0.01-1 in., and preferably approximately 0.19 in. K6 can be approximately 0.5-5 in., and preferably approximately 2.10 in. K7 can be approximately 0.5-5 in., and preferably approximately 1.96 in. K8 can be approximately 0.01-3 in., and preferably approximately 0.25 in. K9 can be approximately 0.06 in. K10 can be approximately 0.01-3 in., and preferably approximately 0.94 in. K11 can be approximately 0.1-10 in., and preferably approximately 5.99 in. K12 can be approximately 0.5-6 in., and preferably approximately 2.53 in. K13 can be approximately 0.25-3 in., and preferably approximately 0.88 in. K14 can be approximately 0.25-3 in., and preferably approximately 0.76 in. K15 can be approximately 0.1-3 in., and preferably approximately 0.50 in.

FIGS. 34A-H illustrate an embodiment of the follower cartridge and its components from various perspectives.

Figure 34A:
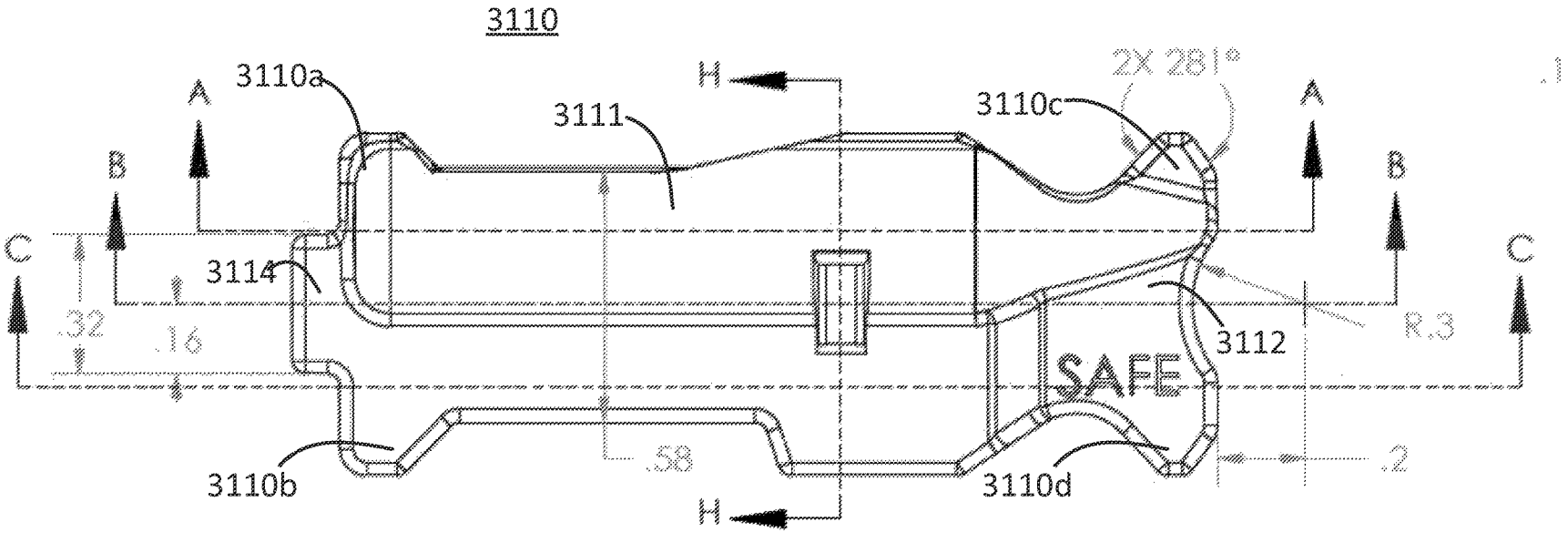
FIG. 34A-H illustrates views of the follower cartridge consistent with one or more aspects of the innovations herein.

FIG. 34A illustrates a top down view of an example cartridge follower 3110 which has a different configuration than those described above. It should be noted that any of various embodiments of cartridge followers including combinations of the various examples described may be used.

In the example of FIG. 34A, the word "SAFE" is etched or molded into the cartridge follower. This is to allow the user to see that the magazine is only intended and can only hold blank rounds and not live rounds.

In the example of FIG. 34A, on one end of the cartridge follower, the first guide 3114 which extends from the back end 3111*b* is shown approximately 0.31-0.33 inches in width, preferably 0.32 inches measured from side 3111*c* to side 3111*d* of the guide.

The second guide 3112 includes lobes 3110*c*, 3100*d* which extend outwardly from the cartridge follower body 3110. The lobes 3110*c*, 3100*d* are shown completing a 75-85 degree, preferable 79 degree arc. Between the two lobes 3110*c*, 3110*d* is a semicircular cutout 3220.

The width across the cartridge follower 3110 main body at the narrowest point can be approx. 0.57-0.59 inches in some examples, preferably 0.58 in. There are approx. 0.17-0.23 in., preferably 0.2 in. of space 3407 between front end 3111*a* and slide insert 3120.

Figure 34B:
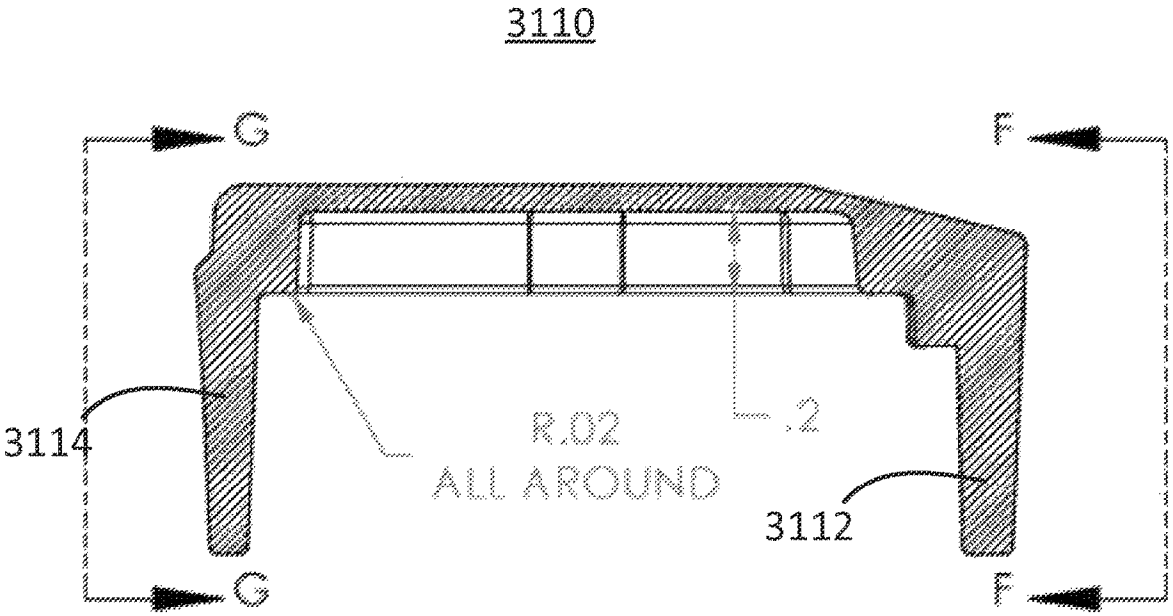

FIG. 34B illustrates a cutaway view from A-A as shown in FIG. 34A. In certain examples, the radius of the body of the blank cartridge mold 3116 can be approx. 0.17-0.23 in., preferably 0.2 in. high.

Figure 34C:
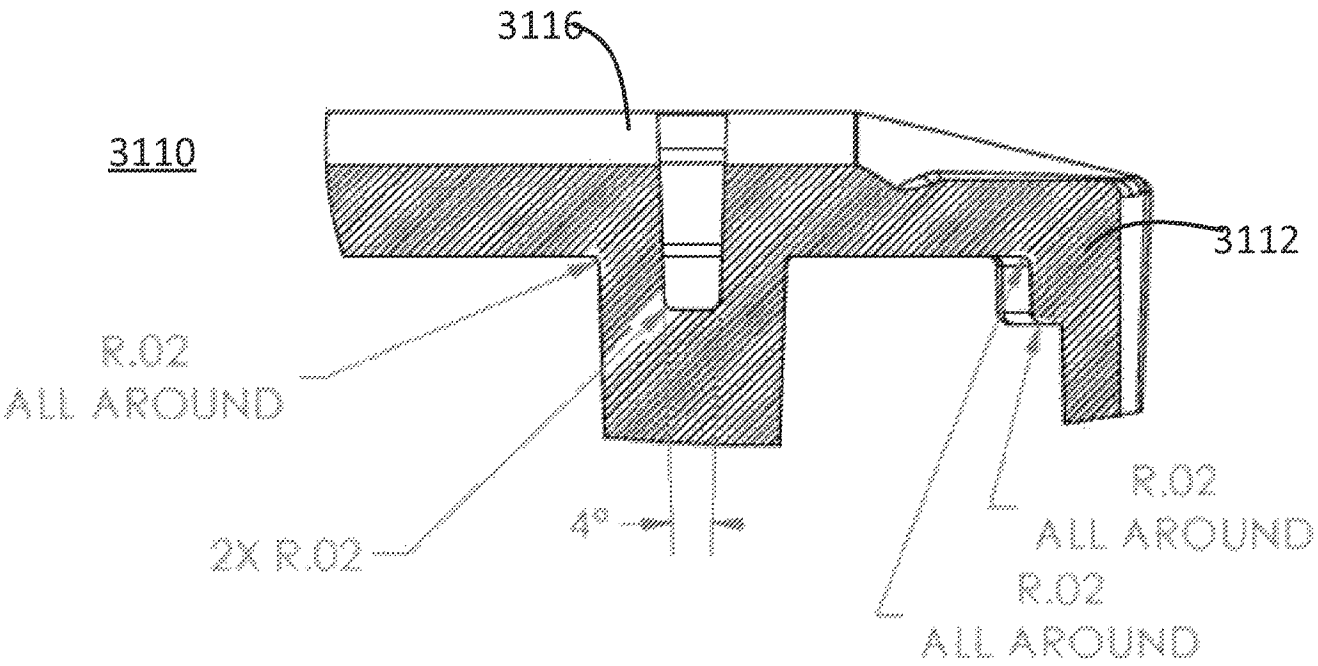

FIG. 34C illustrates a partial cutaway view from B-B as shown in FIG. 34A, focusing on the and center appendage 3220. The downwardly extending sides of the center appendage 3220 each angle inwards approximately 4 degrees. The fillets where the center appendage 3220 meets the bottom of the main cartridge follower body 3111 can be approx. 0.01-0.03 in. each, preferably 0.02 in. The fillets where cartridge follower body 3111 meets the second guide 3112 are all approx. R0.01-R0.03 in., preferably R0.02 in.

Figure 34D:
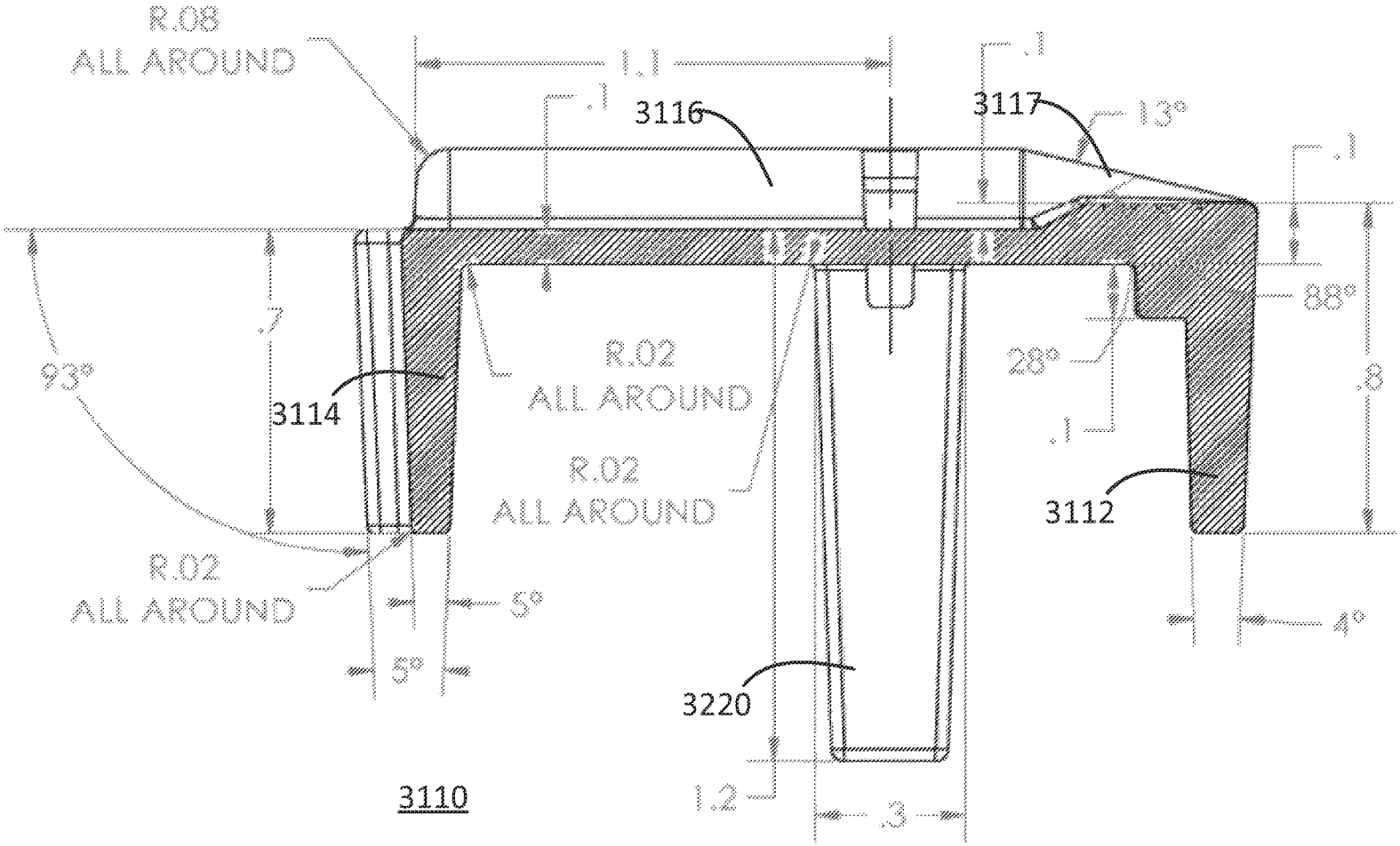

FIG. 34D illustrates a cutaway view from C-C as shown in FIG. 34A, including the cartridge mold 3116, second guide 3112, channel 3112*a*, first guide 3114, the center appendage 3220. In this example, the second guide is shown at an angle between 90 and 96 degrees, preferably, 93 degrees extending from the cartridge follower 3110. Thus, the guides can fit into a curved magazine and slide within it. Second guide 3112 can extend approx. 0.67-0.73 in., preferably 0.7 in. from the cartridge follower 100. In certain embodiments the bottom fillets where channel 3112*a* and guide 3112 meet can be approx. R0.01-R0.03 in., preferably R0.02 in. The farthest edges of channel 3112*a* and guide 3112 angle inward at approximately 5 degrees. The edges of 3112 also angle inwards at approximately 5 degrees. The fillets where the bottom of 3111 and 3112 meet can be approx. R0.01-R0.03 in., preferably R0.02 in. The fillets where the bottom of 3111 and top of meet can be approx. R0.01-R0.03 in., preferably R0.02 in. The center appendage 3220 can be approx. 1.17-1.23 in., preferably 1.2 in. long. The width of the center appendage 3220 where it meets the cartridge follower body 3111 can be approx. 0.27-0.33 in. in certain examples, preferably 0.3 in. Guide blocks 3110*a* and 3110*b* can extend approx. 0.07-0.13 in., preferably 0.01 in. from cartridge follower body 3111. The edges of first guide 3114 angle inwards at approximately 4 degrees. First guide 3114 can extend downwards approx. 0.77, preferably 0.8 in. The distance between the bottom of cartridge follower body 3111 and the top side 3111*b* can be approx. 0.07-0.13 in. apart in certain embodiments, preferably 0.1 in. The blank cartridge mold 3116 front end 3116*a* can have a slope of approximately 13 degrees.

Still referring to FIG. 34D, the thickness of the cartridge follower body 3111 can be approx. 0.07-0.13 in., preferably 0.1 in. The cartridge follower body 3111 may also include a thickness step which increases the thickness at the second guide 3114 end to approximately 0.2 inches. Thus, the example of FIG. 34A shows a stepped thickness of the cartridge follower body 3111 with one end being approximately twice as thick as the other end, and step near the blank cartridge mold 3116 tapered section 3117.

The length of the cartridge follower from side 3111*b* excluding second guide 3112 to the center of the center appendage 3220 can be approx. 1.07-1.13 in., preferably 1.1 in. The measurement from the bottom to the top of side 3111*a* can be approx. 0.07-0.13 in., preferably 0.1 in. The outer curve of the blank cartridge mold 3116 can be approx. R0.07-0.09 in., preferably 0.08 in.

Figure 34E:
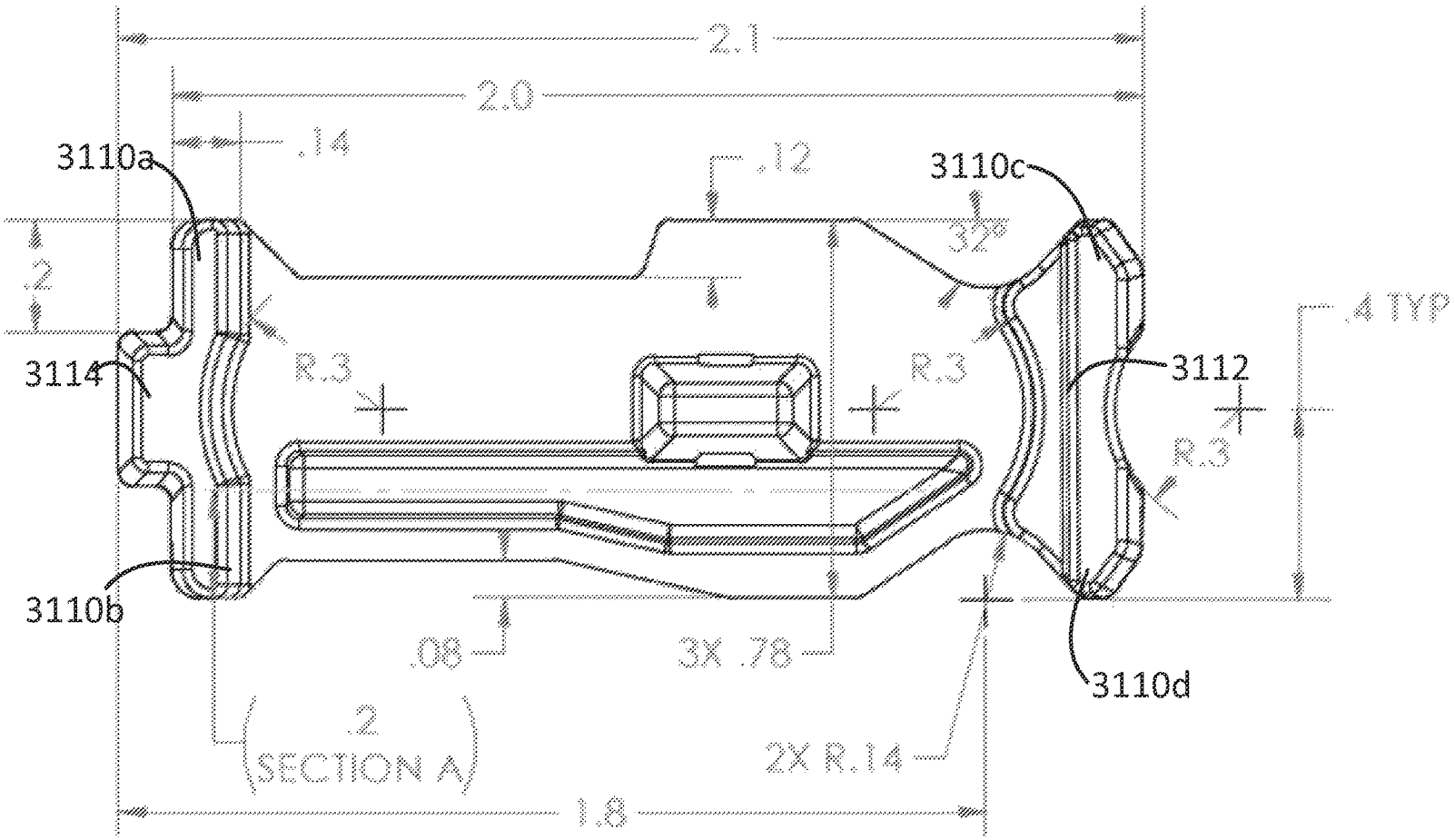

FIG. 34E illustrates an example bottom view of the cartridge follower 3110. As shown in the example, the overall length of the cartridge follower can be approx. 2.07-2.13 in., preferably 2.1 in. long. The overall length of the cartridge follower will of course depend on the dimensions of the slide 3120 which can be used to restrict the loading of live rounds into the magazine, depending on the firearm and caliber round it is intended to be used with. In the example of FIG. 34E the distance of the cartridge follower 3110 without the first guide 3112 can be approx. 1.97-2.03 in., preferably 2.0 in.

In certain examples, a center appendage 3220 is shown extending outwardly from the cartridge follower 3110. The cartridge follower 3110 has a back side with a second guide 3112 to fit into the magazine. In the example shown in FIG. 34E, the back side 3110*a* extends outwardly and is approximately 0.14 to 0.34 in. and preferably 0.24 in. deep. This dimension includes the second guide 3112 which in this example widens into a larger rear guide 3110*b*. In certain examples the dimensions of 3110*a* the second guide 3112 can be can be approx. 0.9-0.11 in., preferably 0.1 in. and the body of the rear guide 0.12 to 0.16 in. and preferably 0.14 in. deep. The sides of the rear guide 3110*b* which extend beyond the second guide 3112 may be between 0.18 and 0.22 in. preferably 0.2 in. wide on either side of the second guide 3112.

Still referring to FIG. 34E, the example shows the rear guide 3110*b* having a semicircular cutout with a radius of approx. R0.27-R0.33 in., preferably R0.3 in. wide. Also shown is a cutout flange near the front of the cartridge follower and the front guide 3110*c*, 3110*d*. This front guide in the example extends outwardly from the cartridge follower in the same way the rear guide 3110*a*, 3110*b* and the center appendage 3220. Further, the front end of the cartridge follower includes cutouts on either side. The example shows dimensions of between 28 and 36 degrees, preferably is 32 degrees. Also shown in the example is the front guide 3110*c*, 3110*d* with a semicircular cutout similar to the one on the rear guide. The semicircular cutout in the front guide is cut from both sides of the front guide making a roughly hourglass shape in the example.

Figure 34F:
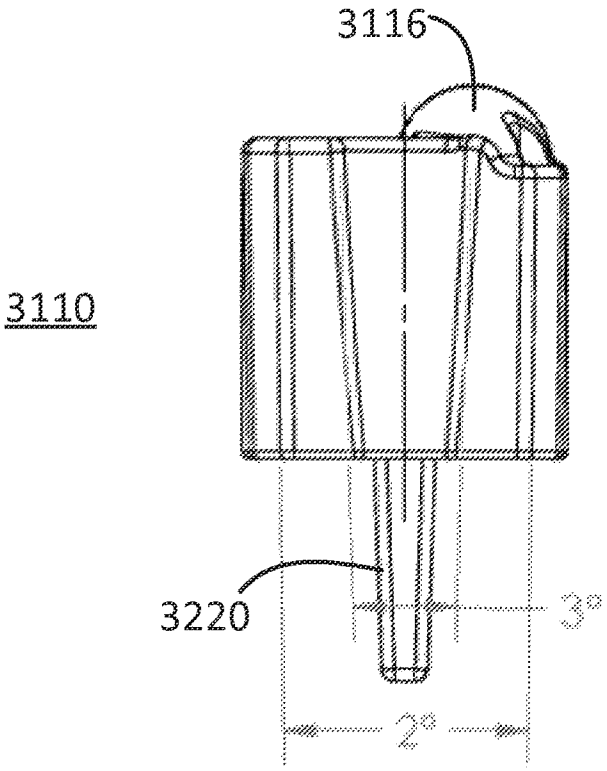

FIG. 34F illustrates a cutaway view from F-F as shown in FIG. 34B, focusing on channel 3112*a* and the part of the center appendage 3220 that extends below it. The inner grooves of channel 3112*a* angle inwards 3 degrees. The outer grooves of channel 3112*a* angle inwards 2 degrees.

Figure 34G:
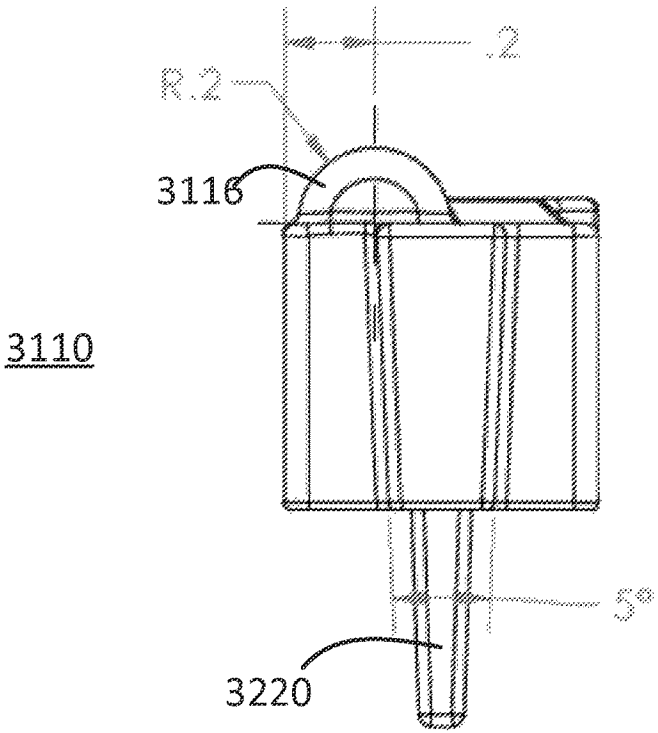

FIG. 34G illustrates a cutaway view from G-G as shown in FIG. 34B from the opposite perspective illustrated in FIG. 34F, focusing on short guide 3114 and the part of the center appendage 3220 that extends below it. The inner grooves on second guide 3114 angle inward 5 degrees. The distance between the outer and inner grooves can be approx. R0.17-R0.23 in. in some examples, preferably R0.2 in. The inner radius of the blank cartridge mold 3116 can be approx. R0.17-R0.23 in., preferably R0.2 in.

Figure 34H:
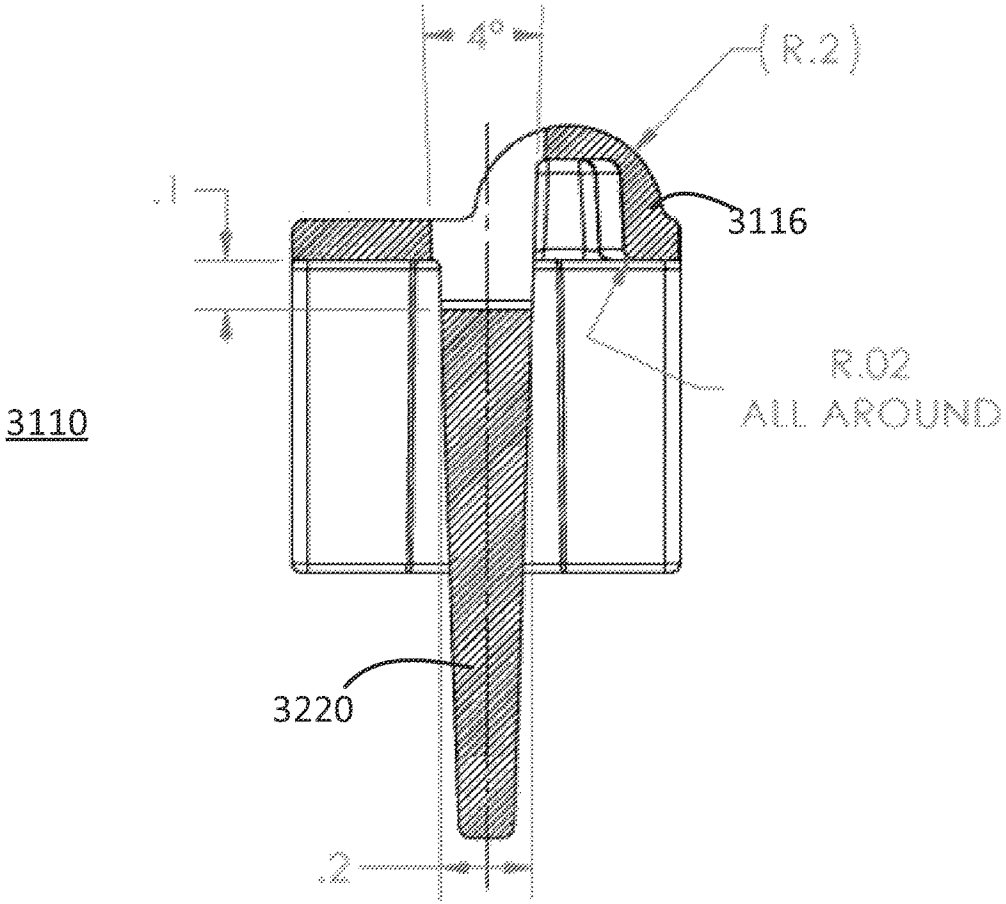

FIG. 34H illustrates a cutaway view from H-H as shown in FIG. 34A, bisecting the center appendage 3220. The base 3220 of the center appendage 3220 can be approx. 0.17-0.23 in., preferably 0.2 in. The sides of followed upwards angle outward 4 degrees. In some examples, the base 3220 and the bottom of cartridge follower 3111 can be approx. 0.07-0.13 in. apart, preferably 0.1 in. The fillets where the blank cartridge mold 3116 meets cartridge follower body 3111 can be approx. R0.01-R0.03 in., preferably R.02 in.

Figure 35A:
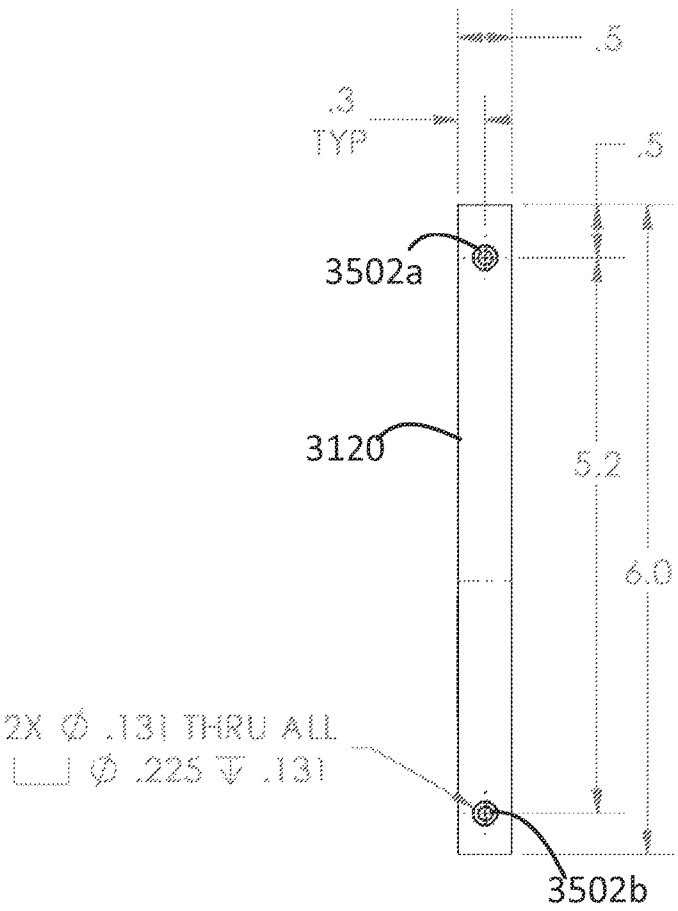
FIG. 35A illustrates a view of the slide insert consistent with one or more aspects of the innovations herein.

FIG. 35A illustrates an example top view of slide insert 3120. Slide insert 3120 has a length of approx. 5.97-6.03 in., preferably 6.0 in., a width of approx. 0.47-0.53 in., preferably 0.5 in., and a depth of approx. 0.17-0.23 in., preferably 0.2 in. Located approx. 0.47-0.53 in., preferably 0.5 in., from the top and bottom of slide insert 3120 are the centers of circular openings 3502*a* and 3502*b*. Circular openings 3502*a* and 3502*b* are both positioned approx. 0.27-0.33 in., preferably 0.3 in., from the left side of slide insert 3120. The distance from the center of circular opening 3502*a* to the center of circular opening 3502*b* can be approx. 5.17-5.23 in., preferably 5.2 in. Circular openings 3502*a* and 3502*b* are both comprised of two circular openings with diameters of approx. 0.126-0.136 in., preferably 0.131 in., within a counter bore where a larger hole with a diameter approx. 0.220-0.230 in., preferably 0.225 in., has a depth of approx. 0.126-0.136 in., preferably 0.131 in.

Figure 35B:
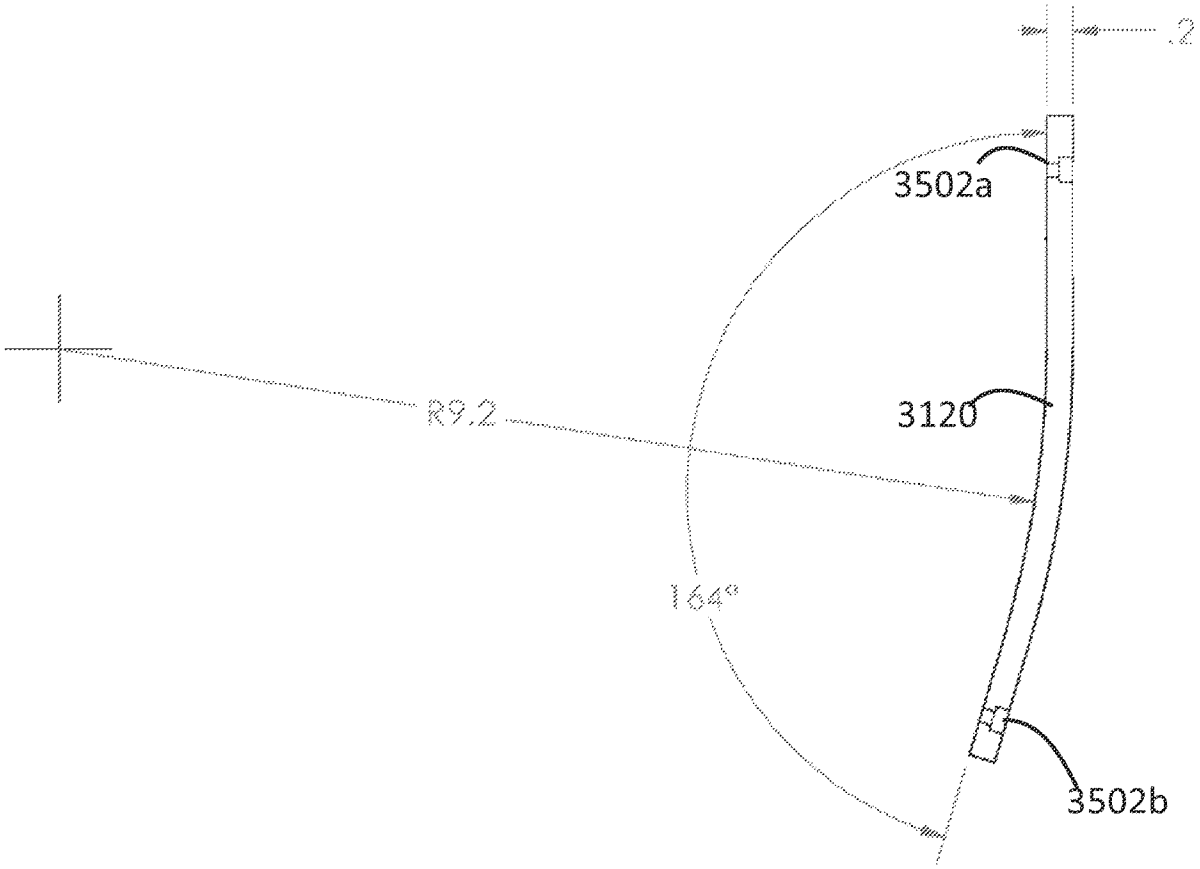
FIG. 35B illustrates another view of the slide insert consistent with one or more aspects of the innovations herein.

FIG. 35B illustrates an example side view of slide insert 3120. The radius of the curve just below the center of slide insert 3120 can be approx. 9.17-9.23 in., preferably 9.2 in. The angle between the planes extending from the top and bottom of slide insert 3120 to the place of curvature is approximately 164 degrees or whatever is necessary to fit into the appropriate magazine.

From the foregoing it will be seen that this invention is one well adapted to attain all ends and objectives hereinabove set forth, together with the other advantages which are obvious and which are inherent to the invention.

Since many possible embodiments may be made of the invention without departing from the scope thereof, it is to be understood that all matters herein set forth or shown in the accompanying drawings are to be interpreted as illustrative, and not in a limiting sense.

While specific embodiments have been shown and discussed, various modifications may of course be made, and the invention is not limited to the specific forms or arrangement of parts described herein, except insofar as such limitations are included in the following claims. For example, it is contemplated within the scope of the invention that the cover and its legs may be attached to the frame or metal frame of the shopping cart and not the basket. Or alternatively, the cover and legs being attached to both the frame and basket. Further, it will be understood that certain features and sub-combinations are of utility and may be employed without reference to other features and sub-combinations.

The invention claimed is:

1. A firearm magazine, comprising:

a housing with a contoured front wall, a contoured rear wall, a floor plate, the front and rear walls connected by two side walls; a removable slide insert with, a length less than a length of the firearm magazine front, rear and side walls, and a width being less than a distance between the magazine side walls; the removable slide insert, shaped to follow the contour of the front wall of the magazine;

having one or more elongated projections running the length of the removable slide insert, wherein the one or more elongate projections have a depth such that the removable slide insert is configured to block cartridges having projectiles from being loaded into the magazine:

including, one or more circular fastener openings formed through the removable slide insert depth configured to match one or more circular fastener openings formed in the magazine contoured front wall;

a cartridge follower configured to fit inside the firearm magazine, the follower having a length less than a distance between the removable slide insert contoured to follow the magazine front wall and the magazine rear wall;

a follower spring configured to fit between the floor plate and the cartridge follower; a front guide protrusion extending from the bottom of the cartridge follower to engage the removable slide insert; a rear guide protrusion extending from the bottom of the cartridge follower to engage the rear wall; and a blank cartridge mold on the top of the cartridge follower with at least two concave grooves, the at least two concave grooves separated by at least one ridge.

2. The firearm magazine of claim 1 wherein the cartridge follower is between 2.0 and 2.2 inches long.

3. The firearm magazine of claim 1 wherein the cartridge follower blank cartridge mold has a hemispherical body with a radius of between 0.1 and 0.3 inches.

4. The firearm magazine of claim 1 wherein the cartridge follower blank cartridge mold has a front end, disposed toward the forward wall of the housing and a rear end, disposed toward the rear wall of the housing.

5. The firearm magazine of claim 1 wherein the cartridge follower blank cartridge mold top includes a forward end that is tapered with a slope of thirteen degrees.

6. The firearm magazine of claim 1 wherein the cartridge follower includes a forward end disposed toward the housing forward wall and a rear end disposed toward the rear housing wall, the forward end of the cartridge follower including a semicircular cutout.

7. The firearm magazine of claim 6 wherein the semicircular cutout has a 0.3 inch radius.

8. The firearm magazine of claim 6 wherein the cartridge follower is twice as thick at the front end as it is at the rear end.

9. The firearm magazine of claim 8 wherein the cartridge follower includes a step where the thickness changes.

10. The firearm magazine of claim 1, wherein the forward wall insert is six inches long, one half inch wide and two tenths inches deep.

11. The firearm magazine of claim 1, wherein the removable insert is insertable into a standard M16 style magazine.

12. A system comprising:

a firearm magazine with a contoured front wall, a contoured rear wall, the front and rear walls connected by two side walls;

a removable slide insert with, a length less than a length of the firearm magazine front, rear and side walls, and a width being less than a distance between the magazine side walls; the removable slide insert, shaped to follow the contour of the front wall of the magazine;

having one or more elongated projections running the length of the removable slide insert, wherein the one or more elongate projections have a depth such that the removable slide insert is configured to block cartridges having projectiles from being loaded into the magazine:

including, one or more circular fastener openings formed through the removable slide insert depth configured to match one or more circular fastener openings formed in the magazine contoured front wall;

a magazine follower configured to fit inside the firearm magazine, the follower having a length less than a distance between the removable slide insert contoured to follow the magazine front wall and the magazine rear wall;

a front guide protrusion extending from the bottom of the cartridge follower to engage the removable slide insert;

a rear guide protrusion extending from the bottom of the cartridge follower to engage the rear wall; and a blank cartridge mold on the top of the cartridge follower with at least two concave grooves, the at least two concave grooves separated by at least one ridge.

13. The system of claim 12 wherein a curvature of the removable slide insert is 164 degrees.

14. The system of claim 12 wherein the width of the removable slide insert is 0.5 inches.

15. The system of claim 12 wherein a thickness of the removable slide insert is 0.2 inches.

16. The system of claim 12 wherein the elongate projection is located in a middle of the width of the removable slide insert.

17. The system of claim 12 wherein the circular fastener openings are separated by 5.2 inches.

* * * * *